US005151059A

United States Patent [19]

Higby

[11] Patent Number: 5,151,059

[45] Date of Patent: Sep. 29, 1992

[54] SHIFTABLE REVERSING TRANSMISSION FOR MARINE PROPULSION DEVICE

[75] Inventor: Jeffrey P. Higby, Wildwood, Ill.

[73] Assignee: Outboard Marine Corporation, Waukegan, Ill.

[21] Appl. No.: 710,163

[22] Filed: Jun. 4, 1991

Related U.S. Application Data

[63] Continuation-in-part of Ser. No. 506,622, Apr. 9, 1990, abandoned.

[51] Int. Cl.[5] ..... B63H 21/28

[52] U.S. Cl. ..... 440/75; 74/378; 192/21; 192/51

[58] Field of Search ..... 440/84, 86, 75; 192/21, 192/51; 74/378, 379, 104, 110

[56] References Cited

U.S. PATENT DOCUMENTS

| | | | |
|---|---|---|---|
| 2,395,223 | 2/1946 | Ingres | 74/110 |
| 2,586,915 | 2/1952 | Cate | 74/110 |
| 3,919,964 | 11/1975 | Hagen | 440/75 |
| 4,223,773 | 9/1980 | Croisant et al. | 192/21 |
| 4,302,196 | 11/1981 | Blanchard | 115/34 |
| 4,637,802 | 1/1987 | Taguchi et al. | 440/75 |
| 4,668,198 | 5/1987 | Nakamura | 440/75 |
| 4,689,027 | 8/1987 | Harada et al. | 440/75 |
| 4,850,910 | 7/1989 | Higby | 440/75 |
| 4,861,295 | 8/1989 | McElroy et al. | 440/86 |
| 4,865,570 | 9/1989 | Highby | 440/86 |

OTHER PUBLICATIONS

1987 Johnson/Evinrude Service Manual.

*Primary Examiner*—Sherman D. Basinger

*Attorney, Agent, or Firm*—Michael, Best & Friedrich

[57] ABSTRACT

A marine propulsion device comprising a lower unit including a gearcase, a propeller shaft mounted in the gearcase for rotation about a generally horizontal fore and aft axis and having an axially extending forwardly opening bore, a shift shaft including a rearward portion located in the bore, a forward portion, and structure for connecting the forward portion to the rearward portion to effect common axial movement of the forward and rearward portions in both directions along the fore and aft axis, a shift lever supported by the lower unit for rotary movement about a horizontal axis transverse to the fore and aft axis, being adapted to be connected to a vertically shiftable link to thereby rock the lever about the transverse horizontal axis, and including a leg, and structure for connecting the leg to the forward portion of the shift shaft to effect movement of the forward portion of the shift shaft in both directions along the fore and aft axis in response to rotary shift lever movement, one of the structure for connecting the forward portion of the rearward portion and the structure for connecting the leg to the forward portion including assembling structure operable incident to forward displacement of the rearward portion of the shift shaft to effect such connection thereof so as thereafter to effect displacement of the shift shaft in both directions along the fore and aft axis in response to rocking movement of the shift lever about the transverse horizontal axis.

66 Claims, 5 Drawing Sheets

SHIFTABLE REVERSING TRANSMISSION FOR MARINE PROPULSION DEVICE

CROSS-REFERENCE TO RELATED APPLICATION

This is a continuation-in-part of co-pending application Ser. No. 506,622, filed Apr. 9, 1990 and entitled "SHIFTABLE REVERSING TRANSMISSION FOR MARINE PROPULSION DEVICE" and now abandoned.

BACKGROUND OF THE INVENTION

1. Field of the Invention

The invention relates generally to marine propulsion devices such as outboard motors and stern drive units. More particularly, the invention relates to transmissions including reversing transmissions for such marine propulsion devices, and is applicable to both so called "counter rotation" and to so called "standard rotation" transmissions. The invention also relates to methods of assembling a reversing transmission in a marine propulsion device.

2. Reference to Prior Art

In the past, some so called "counter rotation" transmissions have included two-piece propeller shafts, i.e., propeller shafts including a forward portion and a rearward portion. Transmission of forward thrust to the gearcase was provided by a thrust ring on a rearward part of the propeller shaft. Inclusion of the thrust ring on the propeller shaft prevented positive assembly of a shift actuating mechanism at the front of the propeller shaft. As a consequence, counter-rotation transmissions employed split shafts to accommodate positive connection of the shift actuating mechanism at the front of the forward propeller shaft portion before assembly of the rearward propeller shaft portion (including the thrust ring) with the forward propeller shaft portion. Standard rotation propeller shafts were one-piece shafts.

More specifically, in the past, and in both counter rotation and standard rotation arrangements, the shift actuating mechanism included provision, at the forward end of the propeller shaft, of a shift shaft having an annular groove and provision of a bell crank shift lever including a leg with an outer end which entered into the groove.

In both the prior counter rotation and standard rotation arrangements, the bell crank shift lever was pivotally mounted in a shift housing and the forwardly locating bevel gear was also initially assembled in the shift housing. Thereafter the resulting shift housing assembly was fitted in the forward end of the gearcase cavity and prevented from rotating by interengagement of a pin on the shift housing with a slot in the gearcase. In addition, and prior to insertion of the shift housing assembly in the gear cavity, the shift shaft and a clutch dog were assembled on the propeller shaft (or the forward portion thereof in the case of the counter rotation arrangement) to form a propeller shaft assembly which was thereafter inserted through the forwardly located bevel gear, and the shift shaft was operably engaged with the pivotally mounted shift lever. The shift housing assembly with the preassembled shift lever and forwardly located bevel gear, together with the propeller shaft assembly (with the shift shaft and shift lever operably engaged) were then inserted into the gearcase cavity.

In the past, the next step was to fix a drive pinion on the drive shaft and in meshing engagement with the forwardly located bevel gear. Due to the crowded condition within the gearcase cavity, i.e., the fact that the propeller shaft was already located in the cavity, proper "torquing" of the nut retaining the drive pinion on the drive shaft was a difficult and costly operation.

Thereafter, in the standard rotation arrangement, a rearwardly located bevel gear and a propeller shaft bearing retainer were then installed into the gearcase cavity in surrounding relation to the propeller shaft. The bearing retainer was then fixed in place.

In the counter rotation arrangement, the rearwardly located bevel gear (together with an assembled thrust canister) was assembled on the rearward propeller shaft portion forwardly of a thrust ring on the rearward propeller shaft portion. This preassembly also included a propeller shaft bearing retainer which was attached to the thrust canister and extended therefrom rearwardly of the thrust ring. The resulting preassembly was then installed into the gearcase cavity, with the rearward propeller shaft portion engaged with the forward propeller shaft portion for common rotation, with the rearwardly located bevel gear in meshing engagement with the drive pinion and in bearing engagement with the gearcase, with the thrust canister engaged with the gearcase for forward thrust transmission therebetween, and with the propeller shaft bearing retainer in engagement with the gearcase cavity. Thereafter the bearing retainer was fixed in place to retain the components within the gearcase cavity.

Attention is directed to the following U.S. Pat. Nos.:

BLANCHARD, 4,302,196, Nov. 24, 1981
TAGUCHI, 4,637,802, Jan. 20, 1987
HARAOA, 4,689,027, Aug. 25, 1987
HIGBY, 4,850,910, Jul. 25, 1989
McELROY, 4,861,295, Aug. 29, 1989
HIGBY, 4,865,570, Sep. 12, 1989

Attention is also directed to the 1987 Johnson/Evinrude Service Manual. The counter rotation arrangement disclosed therein was provided by operating the counter rotation engine in the opposite rotary direction from the direction of rotation of the standard rotation arrangement.

SUMMARY OF THE INVENTION

The invention provides a marine propulsion device comprising a lower unit including a gearcase, a propeller shaft mounted in the gearcase for rotation about a generally horizontal fore and aft axis and having an axially extending forwardly opening bore, a shift shaft including a rearward portion located in the bore, a forward portion, and means for connecting the forward portion to the rearward portion to effect common axial movement of the forward and rearward portions in both directions along the fore and aft axis, a shift lever supported by the lower unit for rotary movement about a horizontal axis transverse to the fore and aft axis, being adapted to be connected to a vertically shiftable link to thereby rock the lever about the transverse horizontal axis, and including a leg, and means for connecting the leg to the forward portion of the shift shaft to effect movement of the forward portion of the shift shaft in both directions along the fore and aft axis in response to rotary shift lever movement, one of the means for connecting the forward portion to the rearward portion and the means for connecting the leg to the forward portion including assembling means operable incident to forward displacement of the rearward portion of the shift shaft to effect such connection thereof so as thereafter to effect displacement of the shift shaft in both directions along the fore and aft axis in response to rocking movement of the shift lever about the transverse horizontal axis.

The invention also provides a propeller shaft assembly for use with a shift actuator, the propeller shaft assembly comprising a propeller shaft having a longitudinal axis and a forwardly open axial bore, a clutch dog mounted on the propeller shaft for common rotary movement with the propeller shaft and for axial movement relative to the propeller shaft, and a shift shaft including a rearward portion located within the bore and fixed to the clutch dog for common axial and rotary movement therewith, a forward portion having a forward end, and means for connecting the forward portion to the rearward portion to effect common axial movement of the forward and rearward portions in both directions along the axis, and means for assembling together one of the shift actuator with the forward portion of the shift shaft and the forward portion of the shift shaft with the rearward portion of the shift shaft incident to forward displacement of the rearward portion of the shift shaft so as to thereafter effect displacement of the shift shaft in the direction of the longitudinal axis in response to movement of the shift actuator.

The invention also provides a marine propulsion device comprising a lower unit including a gearcase a propeller shaft mounted in the gearcase for rotation about a generally horizontal fore and aft axis and having an axially extending forwardly opening bore, a shift mechanism movably supported in the gearcase, and a shift shaft having a rearward portion located in the bore and a forward portion assembled to the shift mechanism to effect movement of the forward portion of the shift shaft in both directions along the fore and aft axis in response to movement of the shift mechanism, and means for connecting the forward portion with the rearward portion incident to forward displacement of the rearward portion to effect such connection so as thereafter to effect common movement of the forward and rearward portions in response to movement of the shift actuator.

The invention also provides a propeller shaft assembly for use with a shift actuator, the propeller shaft assembly comprising a propeller shaft having a longitudinal axis and a forwardly opening axial bore, a clutch dog supported on the propeller shaft for axial movement relative to the propeller shaft and for common rotary movement with the propeller shaft, a shift shaft having a rearward portion located in the bore and a forward portion assembled to the shift actuator to effect movement of the forward portion of the shift shaft in both directions along the axis in response to movement of the shift actuator, and means for connecting the forward portion with the rearward portion incident to forward displacement of the rearward portion to effect such connection so as thereafter to effect common movement of the forward and rearward portions in response to movement of the shift actuator.

The invention also provides a shift shaft for use with a shift actuator to shift a clutch dog relative to a housing having a fore and aft axis and an axial bore, the shift shaft comprising a first portion adapted to be received in the bore, a second portion including a first end adapted to operably engage the shift actuator, and a second end, and means for assembling together said first and second portions of the shift shaft incident to relative axial displacement of the first portion of shift shaft toward the second portion of the shift shaft so as to thereafter effect displacement of the shift shaft in the direction of the fore and aft axis in response to actuating movement of the shift mechanism.

The invention also provides a marine propulsion device comprising a lower unit including a gearcase, a propeller shaft mounted in the gearcase for rotation about a generally horizontal fore and aft axis and having an axially extending forwardly opening bore, a shift shaft located in the bore and including a forward portion, a shift lever supported by the lower unit for rotary movement about a horizontal axis transverse to the fore and aft axis, being adapted to be connected to a vertically shiftable link to thereby rock the lever about the transverse horizontal axis, and including an outwardly extending leg, and means on the leg of the shift lever and on the forward portion of the shift shaft for operably engaging the shift lever with the forward portion of the shift shaft in response to forward movement of the shift shaft, and for displacing the shift shaft in the direction of the fore and aft axis in response to rocking movement of the shift lever about the transverse horizontal axis when the shift lever and the shift shaft are operably engaged.

The invention also provides a marine propulsion device comprising a lower unit including a gearcase, a propeller shaft mounted in the gearcase for rotation about a generally horizontal fore and aft axis and having an axially extending forwardly opening bore, a shift shaft located in the bore and including a forward portion including a forward end, a shift lever supported by the lower unit for rotary movement about a horizontal axis transverse to the fore and aft axis, movable within a shift range between spaced drive positions, and to an assemble position outside of the shift range and spaced from one of the drive positions, being adapted to be connected to a vertically shiftable link to thereby rock the lever about the transverse horizontal axis, and including an outwardly extending leg, and means on the leg of the shift lever and on the forward portion of the shift shaft for operably engaging the shift lever with the forward portion of the shift shaft in response to forward movement of the shift shaft, and for displacing the shift shaft in the direction of the fore and aft axis in response to rocking movement of the shift lever about the transverse horizontal axis when the shift lever and the shift shaft are operably engaged, the means on the leg of the shift lever and on the shift shaft comprising a transversely extending pin carried by the outwardly extending leg of the shift lever, an upwardly open recess which is located on the forward end of the forward portion of the shift shaft, which receives the pin, and which includes a rearward generally vertically extending wall adjacent the pin when the shift shaft is in one of the drive positions and a forward generally vertically extending wall adjacent the pin when the shift shaft is in the other of the drive positions, and an end wall extending upwardly from the rearward vertically extending wall and located for engagement with the pin when the shift lever is in the assemble position and in response to forward movement of the shift shaft.

The invention also provides a marine propulsion device comprising a lower unit including a gearcase having therein a cavity, a propeller shaft mounted in the gearcase cavity for rotation about a horizontal fore and aft axis and having an axially extended forwardly opening bore, a shift shaft located in the bore and including a rearward portion, a forward portion, and means connecting the forward and rearward portions for common axial movement and for relative rotary movement, a bell crank shift lever supported by the lower unit for rotary movement about a horizontal axis transverse to the fore and aft axis and within and relative to a shift range and to an assemble position spaced from the shift range and including a first leg adapted to be connected to a vertically shiftable link to thereby rock the shift lever about the transverse horizontal axis and a second leg extending in angular relation to the first leg and into the gearcase cavity, and means on the second leg of the shift lever and on the forward portion of the shift shaft for operably engaging the shift lever with the shift shaft when the shift lever is in the assemble position and in response to forward movement of the shift shaft, for preventing rotation of the shift shaft forward portion about the fore and aft axis when the shift lever and the shift shaft are operably engaged and the shift lever is in the shift range, for preventing disassembly of the shift lever and the shift shaft when the shift lever and the shift shaft are operably engaged and the shift lever is in the shift range, and for displacing the shift shaft in the direction of the fore and aft axis in response to rocking movement of the shift lever about the transverse horizontal axis and within the shift range when the shift lever and the shift shaft are operably engaged.

The invention also provides a propeller shaft assembly comprising a propeller shaft having a longitudinal axis and a forwardly open axial bore, a bevel gear in surrounding relation to the propeller shaft, a dog clutch mounted on the propeller shaft adjacent the bevel gear for common rotary movement with the propeller shaft and for axial movement relative to the propeller shaft, and a shift shaft located in the axial bore for axial movement relative to the propeller shaft and including a rearward portion fixed to the clutch dog for common axial and rotary movement, a forward portion having a forward end with a recess which extends transversely of the longitudinal axis and which has an upwardly directed opening enabling receipt through the opening of a cross pin on a shift lever to effect movement of the forward portion of the shift shaft in response to rocking movement of the shift lever, and means connecting the forward and rearward portions of the shift shaft for relative rotary movement therebetween and for common axial movement.

The invention also provides a shift shaft having an axis and including a rearward portion adapted to be fixedly connected to a clutch dog for movement in common with the clutch dog, a forward portion having a forward end with a recess which extends transversely to the axis and which has an upwardly directed opening enabling receipt through the opening of a cross pin of a pivotally mounted shift lever so as to effect axial movement of the shift shaft forward portion in response to pivotal movement of the shift lever, and means connecting the rearward and forward portions of the shift shaft for common axial movement and for relative rotary movement.

The invention also provides a shift lever comprising a central portion adapted to be pivotally mounted about an axis, a first leg extending from the central portion and adapted to be connected to a member for rocking the shift lever about the axis, and a second leg extending from the central portion in angularly spaced relation to the first leg and having an outer end with a pin extending parallel to the axis and adapted to be received in a recess in a shift shaft to effect axial movement of the shift shaft in response to rocking movement of the shift lever, the pin extending transversely outwardly on both sides of the second leg.

The invention also provides a marine propulsion device comprising a lower unit including a gearcase, a propeller shaft mounted in the gearcase for rotation about a horizontal fore and aft axis and having an axially extending forwardly opening bore, a shift shaft located in the bore, including a forward portion, being movable in common with the propeller shaft in the direction of the for and aft axis during assembly of the propeller shaft in the gear case, and being movable relative to the propeller shaft to effect operation of a transmission located in the gear case, a shift actuator supported by the lower unit for movement, including a portion locateable in the path of forward movement of the shift shaft in the direction of the fore and aft axis, and being adapted to be connected to a shiftable link to thereby move the shift actuator, and means on the portion of the shift actuator and on the forward portion of the shift shaft for operably engaging the shift actuator with the shift shaft in response to forward movement of the shift shaft in the direction of the fore and aft axis, and for displacing the shift shaft in the direction of the fore and aft axis in response to movement of the shift actuator when the shift actuator and the shift shaft are operably engaged.

The invention also provides a method of assembling a reversing transmission in a cavity provided in a gearcase of a marine propulsion lower unit, which reversing transmission includes a drive pinion fixed to a drive shaft supported by the lower unit and extending into the gearcase cavity, a shift actuator mounted on the lower unit for movement, extending in the gearcase cavity, and adapted to be connected to a shift rod mounted in the lower unit for displacement by an operator, a forwardly located bevel gear rotatably mounted in the lower unit and in meshing relation with the drive pinion, a propeller shaft rotatably mounted in the gearcase cavity and extending in co-axial relation to and through the bevel gear and having a forwardly open axial bore, a clutch dog mounted on the propeller shaft for common rotary movement therewith and for selective axial movement relative to the propeller shaft and relative to a position of engagement with the bevel gear, and a shift shaft located in, and axially movable in, the axial bore in the propeller shaft, fixed to the clutch dog for common rotary and axial movement with the clutch dog, and operably engaged with the shift actuator to effect axial movement of the shift shaft in response to movement of the shift actuator, the method comprising the steps of mounting the shift actuator in the lower unit for movement relative thereto, rotatably mounting the bevel gear in the lower unit for rotation relative thereto, thereafter fixedly mounting the drive pinion on the drive shaft and in meshing engagement with the bevel gear, preassembling the shift shaft in the axial bore in the propeller shaft, preassembling the clutch dog on the propeller shaft and connecting the clutch dog to the shift shaft for common axial and rotary movement, whereby to provide a propeller shaft assembly including the propeller shaft, the clutch dog, and the shift shaft, and thereafter inserting the propeller shaft assembly into the gearcase cavity so as to operably engage the shift shaft with the shift actuator to afford axial shift shaft movement in response to movement of the shift actuator.

The invention also provides a method of assembling a reversing transmission in a cavity provided in a gearcase of a marine propulsion lower unit, which reversing transmission includes a drive pinion fixed to a drive shaft supported by the lower unit and extending into the gearcase cavity, a shift housing non-rotatably received in the gearcase cavity, a shift lever mounted on the shift housing for rotary movement about a horizontal axis, extending in the gearcase cavity, and adapted to be connected to a shift rod mounted in the lower unit for vertical displacement by an operator, a forwardly located bevel gear rotatably mounted in the shift housing and in meshing relation with the drive pinion, a rearwardly located bevel gear rotatably mounted in the gearcase cavity and in meshing relation with the drive pinion, a propeller shaft rotatably mounted in the gearcase cavity and extending in co-axial relation to and through the bevel gears and having a forwardly open axial bore, a clutch dog mounted on the propeller shaft for common rotary movement therewith and for selective relative axial movement therebetween and between spaced positions of engagement with the bevel gears, and a shift shaft located in, and axially movable in, the axial bore in the propeller shaft, fixed to the clutch dog for common rotary and axial movement with the clutch dog, and operably engaged with the shift lever to effect axial movement of the shift shaft in response to rocking movement of the shift lever, the method comprising the steps of preassembling the shift lever in the shift housing for rotary movement relative thereto, preassembling the forwardly located bevel gear in the shift housing for rotation relative thereto, whereby to provide a shift housing assembly including the shift housing, the shift lever, and the forwardly located bevel gear, inserting the shift housing assembly in the gearcase cavity, thereafter fixedly mounting the drive pinion on the drive shaft and in meshing engagement with the forwardly located bevel gear, preassembling the shift shaft in the axial bore in the propeller shaft, preassembling the rearwardly located bevel gear in surrounding relation to the propeller shaft, preassembling the clutch dog on the propeller shaft forwardly of the rearwardly located bevel gear, and connecting the clutch dog to the shift shaft for common axial and rotary movement, whereby to provide a propeller shaft assembly including the propeller shaft, the rearwardly located bevel gear, the clutch dog, and the shift shaft, and thereafter inserting the propeller shaft assembly into the gearcase cavity so as to operably engage the shift shaft with the shift lever to afford axial shift shaft movement in response to pivotal movement of the shift lever, and to rotatably mount the rearwardly located bevel gear in the gearcase cavity and in meshing engagement with the drive pinion.

The invention also provides a method of assembling a reversing transmission in a cavity provided in a gearcase of a marine propulsion lower unit, which reversing transmission includes a drive pinion fixed to a drive shaft supported by the lower unit and extending into the gearcase cavity, a shift housing non-rotatably received in the gearcase cavity, a shift lever mounted on the shift housing for rotary movement about a horizontal axis, extending in the gearcase cavity, and adapted to be connected to a shift rod mounted in the lower unit for vertical displacement by an operator, a forwardly located bevel gear rotatably mounted in the shift housing and in meshing relation with the drive pinion, a rearwardly located bevel gear rotatably mounted in the gearcase cavity and in meshing relation with the drive pinion, a thrust canister assembled with the rearwardly located bevel gear and located in operable engagement with the gearcase for transmission of thrust thereto, a propeller shaft bearing retainer in surrounding and engaged relation to the thrust canister, a propeller shaft rotatably mounted in the gearcase cavity and extending in co-axial relation to and through the bevel gears, the thrust canister, and the propeller shaft retainer, and having a forwardly open axial bore and a rearwardly located thrust ring for transmitting forward thrust to the thrust canister, a clutch dog mounted on the propeller shaft for common rotary movement therewith and for selective relative axial movement therebetween and between spaced positions of engagement with the bevel gears, and a shift shaft located in, and axially movable in, the axial bore in the propeller shaft, fixed to the clutch dog for common rotary and axial movement with the clutch dog, and operably engaged with the shift lever to effect axial movement of the shift shaft in response to rocking movement of the shift lever, the method comprising the steps of preassembling the shift lever in the shift housing for rotary movement relative thereto, preassembling the forwardly located bevel gear in the shift housing for rotation relative thereto, whereby to provide a shift housing assembly including the shift housing, the shift lever, and the forwardly located bevel gear, inserting the shift housing assembly in the gearcase cavity, thereafter fixedly mounting the drive pinion on the drive shaft and in meshing engagement with the forwardly located bevel gear, preassembling the thrust canister and the rearwardly located bevel gear to provide a rearward bevel gear assembly, preassembling the bevel gear assembly in surrounding relation to the propeller shaft and forwardly of the thrust ring, preassembling the propeller shaft bearing retainer in surrounding relation to the propeller shaft and in surrounding and engaged relation to the thrust canister, preassembling the shift shaft in the axial bore in the propeller shaft, preassembling the clutch dog on the propeller shaft forwardly of the bevel gear assembly, and connecting the clutch dog to the shift shaft for common axial and rotary movement, whereby to provide a propeller shaft assembly including the propeller shaft, the rearwardly located bevel gear, the thrust canister, the propeller shaft bearing retainer, the clutch dog, and the shift shaft, and thereafter inserting the propeller shaft assembly into the gearcase cavity so as to operably engage the shift shaft with the shift lever to afford axial shift shaft movement in response to pivotal movement of the shift lever, to rotatably mount the rearwardly located bevel gear in the gearcase cavity and in meshing engagement with the drive pinion, and to engage the propeller shaft bearing retainer with the gearcase.

The invention also provides a method of assembling a reversing transmission in a gearcase cavity in a marine propulsion lower unit, the reversing transmission including a drive pinion fixed to a drive shaft supported by the lower unit, a shift actuator mounted on the lower unit for movement, and extending into the gearcase cavity, a forwardly located bevel gear rotatably mounted in the lower unit and in meshing engagement with the pinion, a propeller shaft rotatably supported in the gearcase and extending in coaxial relation to and through the bevel gear and having a forwardly opening axial bore, a clutch dog supported on the propeller shaft for common rotary movement therewith and selective axial movement relative thereto and relative to a position of engagement with the bevel gear, and a shift shaft including a rearward portion in the axial bore in the propeller shaft and fixed to the clutch dog for common axial and rotary movement therewith, a forward portion assembled with the shift actuator to effect axial movement of the forward portion in response to movement of the shift actuator, and a coupling member supported on one of the rearward and forward portions and engageable with the other of the rearward an forward portions to assemble the rearward and forward portions for common movement, said method comprising the steps of preassembling the forward portion of the shift shaft and the shift actuator, inserting the preassembled forward portion of the shift shaft and the shift actuator into the gearcase cavity such that the shift actuator is supported for movement relative to the lower unit, rotatably mounting the bevel gear in lower unit, mounting the pinion on the drive shaft and in meshing engagement with the bevel gear, preassembling the rearward portion of the shift shaft in the axial bore of the propeller shaft, preassembling the clutch dog on the propeller shaft and connecting the rearward portion to the clutch dog, inserting the propeller shaft together with the clutch dog and the rearward portion of the shift shaft into the gearcase cavity so as to assemble the rearward and forward portions of the shift shaft such that the coupling member connects the rearward and forward portions to afford common axial movement of the rearward and forward portions of the shift shaft incident to movement of the shift actuator.

A principal feature of the invention is the provision of a shift assembly which can be used in standard or counter rotation type marine propulsion transmissions including reversing transmissions to shift the transmission between drive and neutral positions, and which includes a multiple piece shift shaft and a shift mechanism that can be assembled in operative relation to each other within the gearcase via insertion into the gearcase of the propeller shaft assembly including at least a portion of the shift shaft, thereby facilitating the use of a one-piece or a multiplepiece propeller shaft and affording more efficient transmission assembly.

Other features and advantages of the invention will become apparent to those skilled in the art upon review of the following detailed description, claims, and drawings.

BRIEF DESCRIPTION OF THE DRAWINGS

FIG. 5 shows a shift shaft in spaced, disassembled relation to a shift lever and the shift lever in an assemble position. FIG. 6 shows the shift shaft moved to the left relative to the shift lever for engagement with the shift lever. FIG. 7 shows the shift shaft moved further to the left relative to the shift lever and to a drive position. FIG. 8 shows the shift shaft moved still further to the left relative to the shift lever and to a neutral position. FIG. 9 shows the shift shaft moved still further to the left relative to the shift lever and to another drive position.

FIG. 12 shows a forward shift shaft portion in spaced apart, disassembled relation to a rearward shift shaft portion located within the propeller shaft. FIG. 13 shows the propeller shaft moved to the left to engage the forward and rearward portions of the shift shaft. FIG. 14 shows the propeller shaft moved further to the left. FIG. 15 shows the propeller shaft moved still further to the left to partially connect the forward and rearward shift shaft portions. FIG. 16 shows the propeller shaft moved still further to the left to fully connect the forward and rearward shift shaft portions and to position the shift shaft in a drive position. FIG. 17 shows the shift shaft moved to the right relative to the propeller shaft and to a neutral position. FIG. 17 shows the shift shaft moved further to the right relative to the propeller shaft and to another drive position.

Figure 1:
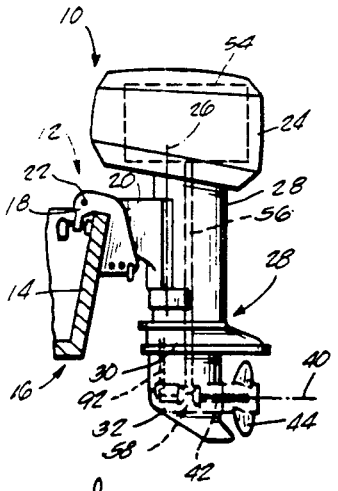
FIG. 1 is a side elevational view of a marine propulsion device which includes a shiftable transmission and which embodies various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

A marine propulsion device 10 embodying various features of the invention is illustrated in the drawings. As shown in FIG. 1, the marine propulsion device 10 is an outboard motor, however, in other arrangements the marine propulsion device 10 could be of other types such as a stern drive unit.

The outboard motor 10 includes a mounting assembly 12 mounted on a transom 14 of a boat 16. While various suitable mounting assemblies can be employed, in the illustrated construction the mounting assembly 12 includes a transom bracket 18 fixed to the transom 14 and a swivel bracket 20 mounted on the transom bracket 18 for pivotal movement of the swivel bracket 20 relative to the transom bracket 18 about a generally horizontal tilt axis 22.

The outboard motor 10 also includes a propulsion unit 24 mounted on the swivel bracket 20 for pivotal movement of the propulsion unit 24 relative to the swivel bracket 20 about a generally vertical steering axis 26. The propulsion unit 24 includes a lower unit 28 having a drive shaft housing 30 and a gearcase 32 at the lower end of the drive shaft housing 30. The gearcase 32 has a hollow interior or cavity 34 (FIG. 2) having a closed forward end 36 and an open rearward end 38, and a generally horizontal fore and aft axis 40. A propeller shaft 42 extends rearwardly from the gearcase 32 and a propeller 44 is suitably mounted on the rearward end of the propeller shaft 42.

Figure 2:
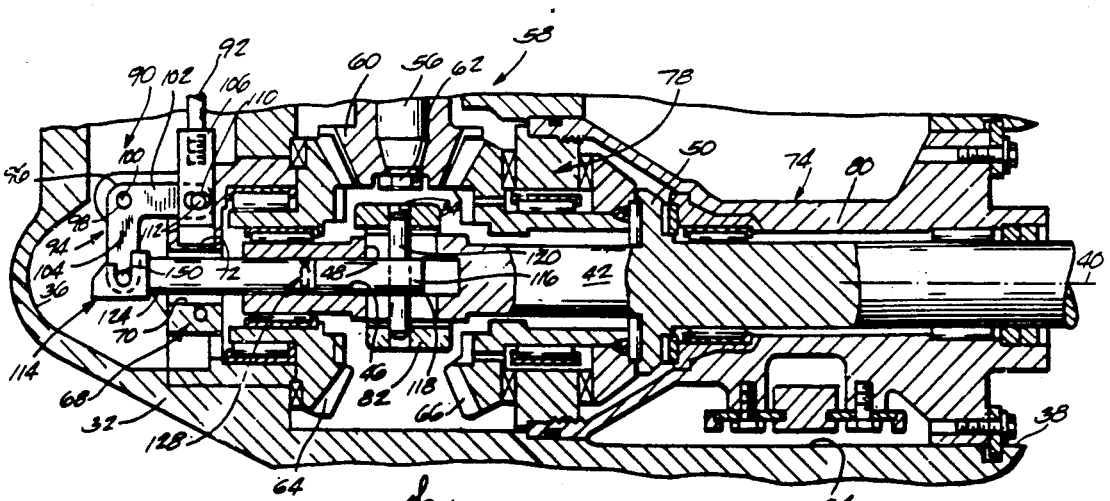
FIG. 2 is an enlarged, cross-sectional view of a portion of the transmission included in the marine propulsion device shown in FIG. 1.

The propeller shaft 42 has a longitudinal axis which in the illustrated arrangement is coaxial with the fore and aft axis 40 and is supported in the gearcase cavity 34 for rotation about the fore and aft axis 40 by means disclosed below. As shown in FIG. 2, the propeller shaft 42 includes an axially extending, forwardly opening bore 46 at the forward end thereof, and a pair of diametrically opposed, axially extending slots 48 communicating with the axial bore 46. The propeller shaft 42 is of one-piece construction and is provided with a thrust ring 50 toward the rearward end thereof.

While in the illustrated arrangement the propeller shaft 42 is of one-piece construction, in other arrangements the propeller shaft 42 can have a split-shaft configuration and can be constructed of multiple suitably interconnected propeller shaft sections.

The propulsion unit 24 also includes an internal combustion engine 54 mounted on the lower unit 28. The engine 54 is drivingly connected through the propeller shaft 42 to the propeller 44 by drive means including a vertically extending drive shaft 56 which is supported in the drive shaft housing 30 and which has a lower end extending into the gearcase cavity 34.

To translate drive shaft rotation into propeller shaft rotation, the drive means also includes a transmission 58 which is located in the gearcase cavity 34 and which is operable to selectively couple the drive shaft 56 to the propeller shaft 42 in force transmitting relation. In the illustrated arrangement, the transmission 58 is a reversing transmission and is of the counter rotation type, however, in other arrangements a standard rotation type transmission could be employed.

As shown in FIG. 2, the transmission 58 includes a drive pinion 60 secured to the lower end of the drive shaft 56 by a threaded locking nut 62 or other suitable means. To selectively transmit force from the vertical drive shaft 56 to the horizontal propeller shaft 42, the transmission 58 also includes a pair of spaced apart bevel gears 64 and 66 supported in the gearcase cavity 34 in surrounding coaxial relation to the propeller shaft 42 and for rotation about the fore and aft axis 40. The bevel gears 64 and 66 are located, respectively, forwardly and rearwardly of the pinion 60 so as to mesh with opposite sides of the pinion 60. Thus, the forwardly and rearwardly located bevel gears 64 and 66 constantly rotate in opposite directions in response to pinion rotation. Accordingly, by selectively coupling one or the other of the forwardly and rearwardly located bevel gears 64 and 66 to the propeller shaft 42, rotation of the propeller shaft 42 in either direction can be achieved.

In the illustrated construction, the transmission 58 is shiftable between a forward drive condition, a neutral condition, and a rearward or reverse drive condition, as will be further explained below. As shown in FIG. 2, the forwardly located bevel gear 64 is the reverse drive bevel gear and is coupled to the propeller shaft 42 during reverse operation of the outboard motor 10, and the rearwardly located bevel gear 66 is the forward drive bevel gear and is coupled to the propeller shaft 42 during forward operation of the motor 10. In an outboard motor employing a standard rotation transmission this arrangement is reversed.

To support the forwardly located bevel gear 64, the transmission 58 is provided with means for supporting the forwardly located bevel gear 64 within the gearcase cavity 34 for rotation about the fore and aft axis 40. While various suitable bevel gear supporting means can be employed, in the illustrated construction such means includes a generally cupped-shaped bevel gear bearing housing or shift housing 68 located in relatively close fitting relation within the gearcase cavity 34 and adjacent the closed forward end 36 thereof. Interengaging means (not shown) are provided between the shift housing 68 and the gearcase 32 to prevent relative rotation therebetween. Located centrally in the shift housing 68 is a bore 70 which is coaxially aligned with the propeller shaft 42 and which is sized to afford passage therethrough of an enlarged forward end of a shift shaft which will hereinafter be disclosed. The shift housing 68 also includes a generally vertically oriented guideway 72. Additionally, the shift housing 68 provides support for the forward end of the propeller shaft 42 which is rotatably supported within the forwardly located bevel gear 64.

To rotatably support the rearward end of the propeller shaft 42 and to transfer forwardly directed thrust from the propeller shaft 42 to the gearcase 32, the transmission 58 includes a propeller shaft bearing housing assembly 74. The propeller shaft bearing housing assembly 74 is positioned within the gearcase cavity 34 adjacent the rearward end 38 thereof and is disclosed in U.S. Pat. No. 4,850,910 issued Jul. 25, 1989 to Higby et al. which is incorporated herein by reference.

Briefly, the propeller shaft bearing housing assembly 74 includes a rearwardly located bevel gear assembly 76 including the rearwardly located bevel gear 66 and a thrust canister 78. The thrust canister 78 is assembled to the rearwardly located bevel gear 66 and is positioned forwardly of the thrust ring 50 on the propeller shaft 42. The thrust canister 78 is configured to engage the thrust ring 50 to transmit thrust from the propeller shaft 42 to the gearcase 32 during forward operation of the outboard motor 10. Additionally, the propeller shaft bearing housing assembly 74 includes a propeller shaft bearing housing or retainer 80. The propeller shaft bearing retainer 80 surrounds the rearward part of the propeller shaft 42 and is releaseably fixed against removal from the gearcase cavity 34 by any suitable means. Retention of the propeller shaft bearing retainer 80 in the gearcase cavity 34 prevents rearward withdrawal of the propeller shaft 42 and the thrust canister 78 from the gearcase 32.

The transmission 58 also includes means for selectively coupling the propeller shaft 42 for co-rotation with one or the other of the forwardly and rearwardly located bevel gears 64 and 66. While various suitable selective coupling means can be employed, in the illustrated construction such means includes a clutch dog 82 which is provided with diametrically opposed apertures 84 and which is carried on the propeller shaft 42 by suitable splines (not shown) for common rotation with the propeller shaft 42. The splined connection of the clutch dog 82 and the propeller shaft 42 facilitates axial movement of the clutch dog along the propeller shaft 42 within a shift range including therein a central or neutral position (shown in FIG. 2) spaced from each of the forwardly and rearwardly located bevel gears 64 and 66. More specifically, the shift range is defined between a first drive position forward of the neutral position and adjacent the forwardly located bevel gear 64, and a second drive position rearward of the neutral position and adjacent the rearwardly located bevel gear 66.

Means are provided on the clutch dog and on the bevel gears 64 and 66 for interengaging the clutch dog 82 with whichever one of the forwardly or rearwardly located bevel gears 64 and 66 the clutch dog 82 is moved toward to cause common rotation of the clutch dog 82 and the selected bevel gear. Such interengaging means can include drive lugs (not shown) or other suitable means. Since the clutch dog 82 is nonrotatable relative to the propeller shaft 42, the propeller shaft 42 is caused to co-rotate with whichever of the bevel gears 64 and 66 the clutch dog 82 is engaged with. When the clutch dog 82 is positioned in the neutral position the interengagement means is disengaged and the propeller shaft 42 is not driven in either direction.

The means for selectively coupling the propeller shaft 42 with one or the other of the bevel gears 64 and 66 also includes operating means for shifting the clutch dog 82 within the shift range and between the neutral and drive positions in response to operator activity. While various operating means 86 can be employed, in the illustrated construction such means includes a transmission shifting arrangement or shift assembly 90.

In the construction illustrated in FIGS. 2–9, the shift assembly 90 includes an elongated shift rod 92 which is suitably supported by the drive shaft housing 30 for vertical movement and which extends downwardly into the gearcase cavity 34. The shift rod 92 is connected at one end to a control mechanism (not shown) which is engageable by an operator to move the shift rod 92 upwardly or downwardly.

The shift assembly 90 also includes a movably mounted shift actuating member or shift actuator 94. In the illustrated arrangement the shift actuator 94 is a generally L-shaped rocker arm or shift lever in the form of a bell crank. The shift lever 94 includes a central portion 96 supported by a generally horizontal pivot pin 98 to facilitate rocking or pivotal movement of the shift lever 94 about a generally horizontal axis 100 oriented transversely to the fore and aft axis 40. The pivot pin 98 is preferably supported on the shift housing 68 to ensure the generally horizontal disposition of the transverse axis 100, but could also be supported by other means such as by the gearcase 32. The shift lever 94 also includes a rearwardly extending first leg 102 and a second leg 104 extending downwardly into the gearcase cavity 34.

Figure 3:
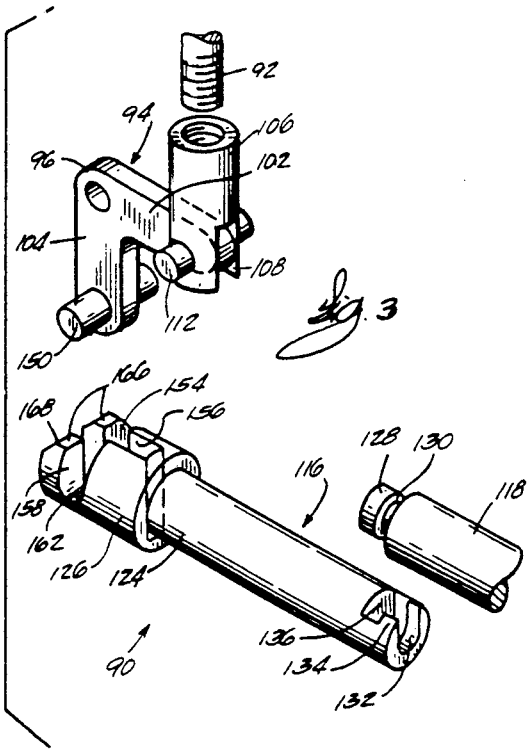
FIG. 3 is an exploded perspective view of various components of a transmission shifting arrangement included in the transmission shown in FIG. 2.

In order to couple the shift rod 92 to the shift lever 94 to pivot the shift lever 94 in response to vertical shift rod movement, the shift assembly 90 is provided with a shift rod link or coupler 106 (see FIG. 3). The shift rod coupler 106 is received in the guideway 72 for reciprocal movement therein and threadingly receives the lowermost end of the shift rod 92. The shift rod coupler 106 includes in its lower end a first slot 108 (FIG. 3) which receives the outer end of the first leg 102. The shift rod coupler 106 is also provided with a pair of opposed second slots 110 transverse to said first slot 108. A cross pin 112 extending from the each of the opposite sides of the outer end of the first leg 102 is received in the second slots 110 to pivotally connect the first leg 102 to the shift rod coupler 106.

The shift assembly 90 also includes a connecting linkage 114 between the second leg 104 of the shift lever 94 and the clutch dog 82 to accomplish axial movement of the clutch dog 82 along the propeller shaft 42 in response to pivoting of the shift lever 94. The connecting linkage includes an elongate, generally horizontal shift shaft 116 reciprocally received in the axial bore 46 in the propeller shaft 42 and in coaxial relation to the fore and aft axis 40.

As shown in FIGS. 2 and 3, the shift shaft 116 includes a rearward portion 118 which is received in the axial bore 46 of the propeller shaft 42. A connector pin 120 extends through the rearward end of the rearward shift shaft portion 118, through the opposed slots 48 in the propeller shaft 42 and into the opposed apertures 84 in the clutch dog 82 to couple the rearward shift shaft portion 118 to the clutch dog 82 for common rotary movement and axial movement within the shift range of the clutch dog 82. The shift shaft 116 also includes a forward portion 124 which projects forwardly and outwardly from the axial bore 46 and which extends axially through the bore 70 in the shift housing 68 and forwardly thereof. The forward shift shaft portion 124 includes an enlarged forward end 126 which is inserted through the bore 70 in the shift housing 68 during assembly of the transmission 58 in the gearcase 32.

The shift shaft 116 also includes means for connecting the rearward and forward shift shaft portions 118 and 124 to effect common axial movement thereof along the fore and aft axis 40 and within the axial bore 46 of the propeller shaft 42. For reasons more fully set forth hereinafter, the forward shift shaft portion 124 is nonrotatable. Hence, the means for connecting the rearward and forward shift shaft portions 118 and 124 also connects these portions for relative rotary movement. While various means can be employed for connecting the rearward and forward shift shaft portions 118 and 124 to afford common axial and relative rotary movement therebetween, in the illustrated arrangement, and as best shown in FIG. 3 such connecting means includes formation of the forward end of the rearward shift shaft portion 118 with a reduced diameter end section 128 and with a still further reduced annular groove 130 rearwardly and inwardly of the end section 128. Additionally, the rearward end of the forward shift shaft portion 124 is provided with a first radially open slot 132 defining a projection 134 adapted to extend into the annular groove 130. Communicating with the first radially open slot 132 is an enlarged second radially open ®d slot 136 which receives the end section 128 of the rearward shift shaft portion 118.

To assemble the rearward and forward shift shaft portions 118 and 124, the end section 128 of the rearward shift shaft portion 118 is located in the second radially open slot 136 in the forward shift shaft portion 124 to ensure common axial movement of the rearward and forward shift shaft portions 118 and 124. The shift shaft 116 is thereafter inserted into the axial bore 46 in the propeller shaft 42 such that the connecting means is located within the axial bore 46. Such insertion prevents axial disconnection of the rearward and forward shift shaft portions 118 and 124 while affording relative rotation therebetween.

Figure 4:
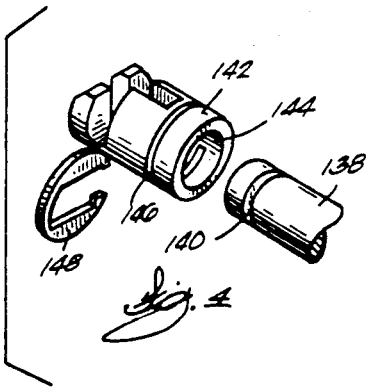
FIG. 4 is an exploded perspective view of various components of a modified version of the transmission shifting arrangement shown in FIG. 3.
Figure 8:
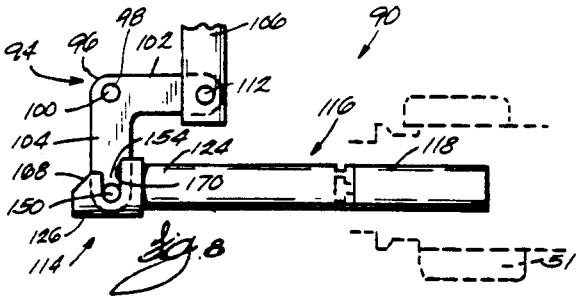
Figure 9:
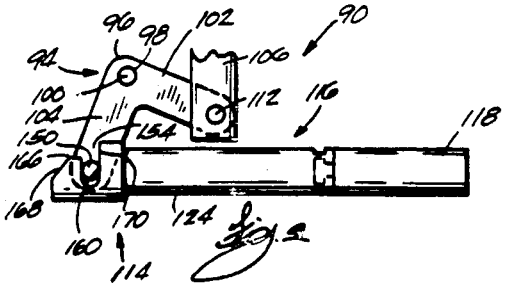

Shown in FIG. 4 is an alternative shift shaft construction or arrangement which employs a modified means for connecting together a pair shift shaft portions for common axial movement and for relative rotary movement. In this modified construction, the forward part of a modified rearward shift shaft portion 138 includes an annular groove 140 spaced rearwardly from the forward end thereof. This construction also includes a modified forward shift shaft portion 142 which is positioned forwardly of the propeller shaft 42 at all times, which is of larger size than the rearward shift shaft portion 138, and which includes a rearwardly open circular bore 144 that rotatably receives the forward part of the rearward shift shaft portion. The forward shift shaft portion 142 also includes one or more transverse, semi-annular slots 146 (only one is shown) which are axially alignable with the annular groove 140 in the rearward shift shaft portion 138. A C-shaped clip 148 extends into the semi-annular slot 146 and into the groove 140 so as to prevent axial disassembly of the modified rearward and forward shift shaft portions 138 and 142 while permitting relative rotation therebetween.

Referring to both the counter rotation and standard rotation transmission arrangements, transmission assembly generally includes mounting the shift lever 94 in the lower unit 28, connecting the shift rod 92 to the shift lever 94, and installing the drive pinion 60 and the forwardly located bevel gear 64. Thereafter, in order to facilitate insertion of the propeller shaft 42 into the gearcase cavity 34, and in order to further facilitate operative assembly of the shift shaft 116 with the shift lever 94, the connecting linkage 114 is provided with means for releaseably and operably engaging or assembling the second leg 104 of the shift lever 94 with the enlarged forward end 126 of the forward shift shaft portion 124. In the illustrated arrangement, and as shown with reference to FIGS. 5–9, such assembling means is intended to be operable incident to forward displacement of the shift shaft 116 relative to the shift lever 94 to effect engagement and connection of the shift shaft 116 and the shift lever 94.

More specifically, and while other means for assembling the shift shaft 116 and the shift lever 94 can be employed, in the illustrated construction, such assembling means includes at the outer end of the second leg 104 of the shift lever 94 a cross link or pin 150. The cross pin 150 extends transversely to the fore and aft axis 40 and from both sides of the second leg 104 and has a thickness dimension 152 in the fore and aft direction.

The assembling means also includes formation of an upwardly open recess 154 and an axially extending slot 156 in the enlarged forward end 126 of the forward shift shaft portion 124 to receive the cross pin 150 and the outer end of the second leg 104. As a consequence of the receipt of the outer end of the second leg 104 and the cross pin 150 in the axial slot 156 and in the upwardly opening recess 154, the forward shift shaft portion 124 is prevented from rotating.

The upwardly opening recess 154 is defined between a forward vertical wall 158, a rearward vertical wall 160, and a lower semi-cylindrical wall 162 extending between the forward and rearward vertical walls 158 and 160 and transversely of and partially below the fore and aft axis 40. The upwardly opening recess 154 has a length dimension 164 in the fore and aft direction that is slightly greater than the thickness 152 of the cross pin 150.

The shift lever 94 is pivotable throughout a range which corresponds to the shift range of the shift shaft 116 and clutch dog 82 arrangement. When not engaged with the shift shaft 116, the shift lever 94 is pivotable outside of the pivot or shift range to an assemble position (see FIGS. 5 and 6). In this regard, the forward vertical wall 158 has a top surface 166 which is located just below the bottom of the cross pin 150 when the shift lever 94 is in the assemble position. As a consequence, the shift shaft 116 can be moved forwardly to permit passage of the forward vertical wall 158 under the cross pin 150 when the shift shaft 116 is in the assemble position. Extending downwardly and forwardly from the top surface 166 is an inclined surface 168 which, if the shift lever 94 is spaced slightly below the assemble position, will engage and cam the shift lever 94 to the assemble position in response to forward movement of the shift shaft 116.

The rearward vertical wall 160 of the enlarged forward end 126 of the forward shift shaft portion 124 merges into an end wall 170 which extends upwardly above the top surface 166 either in coplanar relation to the rearward vertical wall 160 or upwardly in inclined relation to the rearward vertical wall 160, and can be either flat or curved, as desired. The end wall 170 extends into the path of the cross pin 150 in response to continued forward movement of the shift shaft 116. Consequently, a cross section taken through the upwardly opening recess 154 and axially along the fore and aft axis 40 is non-symmetrical about the axis 100 of the pin 98.

Figure 5:
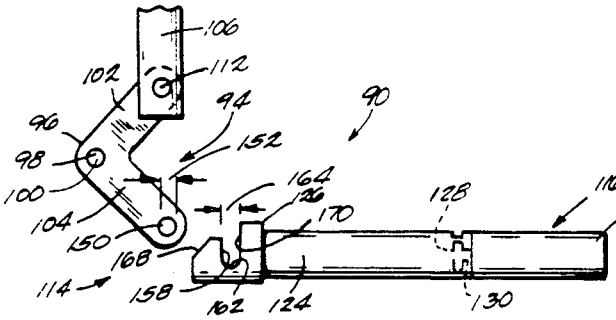
FIGS. 5–9 are enlarged, partially schematic side views illustrating assembly and operation of certain of the components of the transmission shifting arrangement included in the transmission shown in FIG. 2. More particularly.
Figure 6:
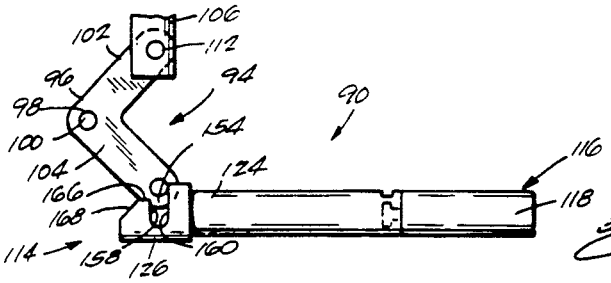
Figure 7:
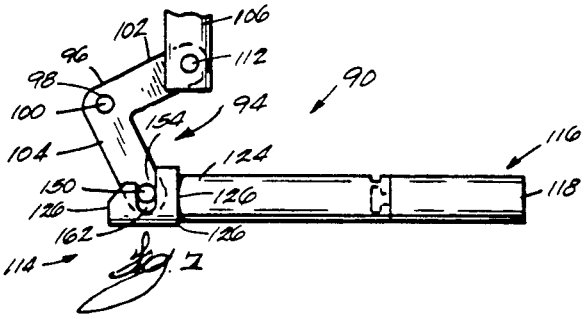

During assembly of the shift shaft 116 and the shift lever 94, a first increment of forward movement of the shift shaft 116 relative to the shift lever 94 when the cross pin 150 is in the assemble position initially causes travel of the forward vertical wall 158 beneath the cross pin 150 and then engagement of the cross pin 150 with the end wall 170 (see FIGS. 5 and 6). Such engagement and continued forward movement of the shift shaft 116 causes pivoting of the shift lever 94 from the assemble position and into the shift range, and travel of the cross pin 150 downwardly into the upwardly opening recess 154 and between the forward and rearward vertical walls 158 and 160 (see FIG. 7), thereby operatively and automatically assembling the shift shaft 116 and the shift lever 94 incident to forward movement of the shift shaft 116 toward the shift lever 94. Thereafter, while in the shift range, axial movement of the shift shaft 116 in the direction of the fore and aft axis 40 between the neutral position, the forward drive position, and the reverse drive position in response to pivoting of the shift lever 94 consequent to vertical shift rod movement incident to operator activity is accomplished (see FIGS. 7–9).

In the counter rotation arrangement, when the propeller shaft 42 is inserted into the gearcase cavity 34 to operatively assemble the shift shaft 116 with the shift lever 94, the shift shaft 116, the clutch dog 82, the connector pin 120, the rearwardly located bevel gear 66, the thrust canister 78, and the propeller shaft bearing retainer 80 are all preferably preassembled on the propeller shaft 42 to form a propeller shaft assembly. After assembly of the propeller shaft assembly into the gearcase cavity 34, and operable engagement with the shift lever 94, the propeller shaft bearing retainer 80 is fixed in place to prevent disassembly of the propeller shaft assembly from the gearcase 32. The propeller 44 can later be secured to the rearward end of the propeller shaft 42. Additionally, when the components are in the shift range, unintended disengagement of the cross pin 150 from the upwardly opening recess 154 is prevented and rotation of the forward shift shaft portion 124 is prevented.

Also, in the standard rotation arrangement, the thrust ring 50 on the propeller shaft 42 can be omitted and the thrust canister 78 is also omitted from the propeller shaft preassembly. The propeller shaft bearing retainer 80 can be part of the preassembly or can be inserted into the gearcase cavity 34 after insertion of the propeller shaft assembly.

Additionally, it is noted that when the transmission 58 employs the shift assembly 90 and is fully assembled, i.e., when the rearwardly located bevel gear 66 is located in surrounding relation to the propeller shaft 42 and forwardly of the thrust canister 78, movement of the shift shaft 116 is limited to movement within the shift range.

Thus, the disclosed construction enables assembling of the counter rotation reversing transmission 58 in the cavity 34 of the gearcase 32 of the marine propulsion lower unit 28 by preassembling the shift lever 94 in the shift housing 68 for rotary movement relative thereto, preassembling the forwardly located bevel gear 64 in the shift housing 68 for rotation relative thereto, whereby to provide a shift housing assembly including the shift housing 68, the shift lever 94, and the forwardly located bevel gear 64, inserting the shift housing assembly in the gearcase cavity 34, thereafter fixedly mounting the drive pinion 60 on the drive shaft 56 and in meshing engagement with the forwardly located bevel gear 64, preassembling the thrust canister 78 and the rearwardly located bevel gear 66 to provide a rearward bevel gear assembly, preassembling the rearward bevel gear assembly in surrounding relation to the propeller shaft 42 and forwardly of the thrust ring 50, preassembling the bearing retainer 80 to the propeller shaft 42 and the rearward bevel gear assembly, preassembling the shift shaft 116 in the axial bore 46 in the propeller shaft 42, preassembling the clutch dog 82 on the propeller shaft 42 forwardly of the bevel gear assembly, and connecting the clutch dog 82 to the rearward shift shaft portion 118 for common axial and rotary movement, whereby to provide a propeller shaft assembly including the propeller shaft 42, the rearwardly located bevel gear 66, the thrust canister 78, the clutch dog 82, the bearing retainer 80 and the shift shaft 116, and thereafter inserting the propeller shaft assembly into the gearcase cavity 34 so as to operably engage the shift shaft 116 with the shift lever 94 to afford axial shift shaft movement in response to pivotal movement of the shift lever 94, to rotatably mount the rearwardly located bevel gear 64 in the gearcase cavity 34 and in meshing engagement with the drive pinion 60, and to engage the thrust canister 78 with the gearcase 32. Thereafter the propeller shaft bearing retainer 80 is fixed in place to releaseably prevent propeller shaft removal.

Of course, standard rotation transmissions without the thrust ring 50 and thrust canister 78 can also be assembled in accordance with the invention. The bearing retainer 80 can be a part of the preassembly or can be inserted into the gearcase cavity 34 after insertion of the propeller shaft assembly.

Illustrated in FIGS. 10–18 is a second embodiment of the operating means for shifting the clutch dog 82 within the shift range and wherein like numerals denote like components. In this embodiment, an alternative shift assembly 200, and particularly an alternative connecting linkage 202 is employed.

Figure 10:
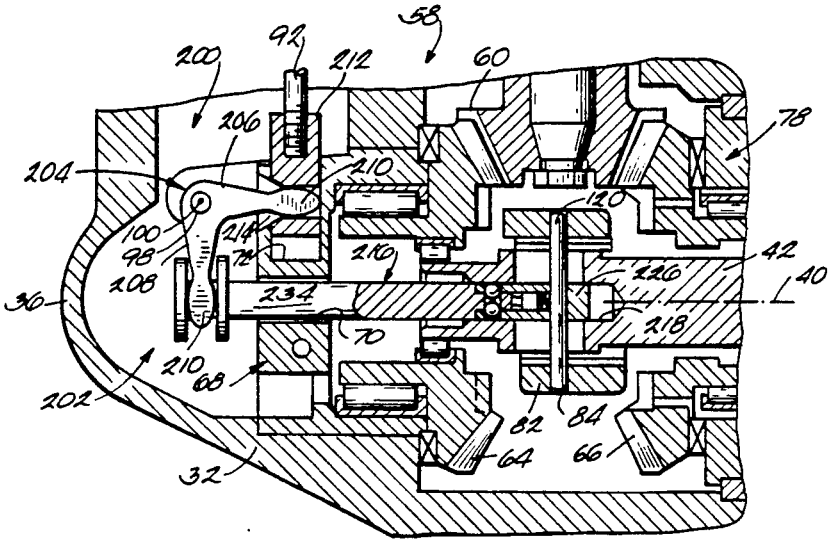
FIG. 10 is an enlarged view similar to FIG. 2, but showing a transmission including a second embodiment of the transmission shifting arrangement.

More specifically, the shift assembly 200 includes a modified shift lever 204 including first and second legs 206 and 208 having enlarged outer ends 210 with generally arcuate peripheries (see FIG. 10). To accomplish pivotal movement of the shift lever 204 in response to vertical movement of the shift rod 92, The shift assembly 200 also includes a shift rod coupler 212 having a rectangularly sectioned slot 214 for receiving the enlarged outer end 210 of the first leg 206. The rectangular slot 214 is forwardly flared to provide clearance for the first leg 206 as it pivots about axis 100.

Figure 11:
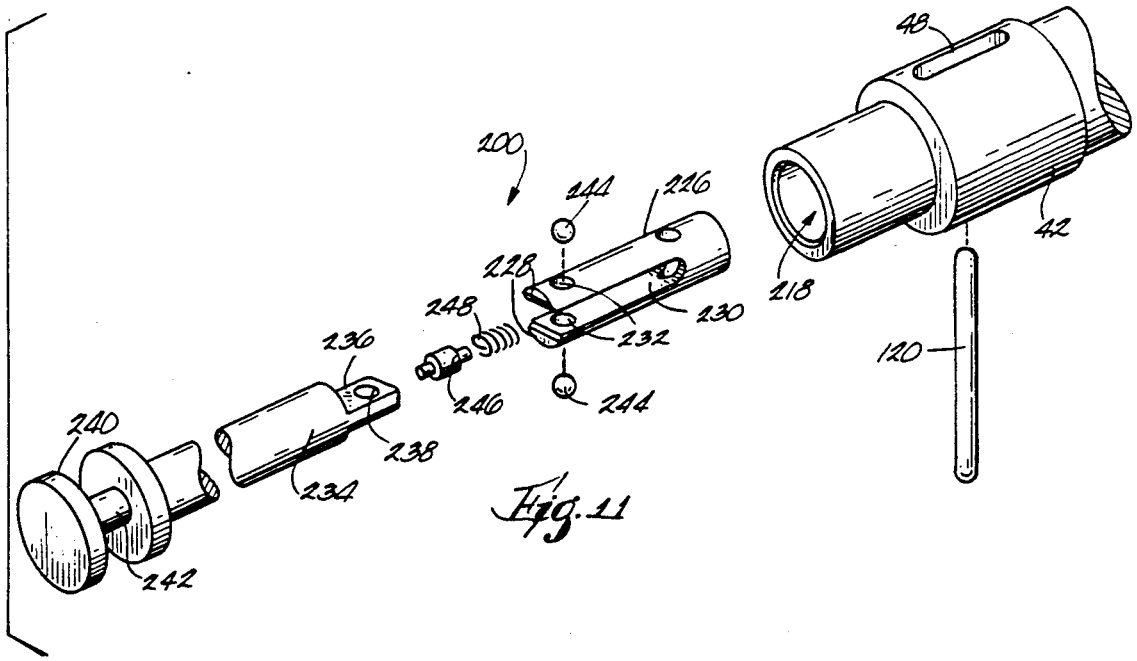
FIG. 11 is an exploded perspective view of various components of the transmission shifting arrangement shown in FIG. 10.

As shown with respect to FIGS. 10 and 11, the connecting linkage 202 includes an elongated, generally horizontally extending, two-piece shift shaft 216 reciprocally received in a modified axial bore 218 in the propeller shaft 42 and in coaxial relation to the fore and aft axis 40. To assist in assembling the shift shaft 216, as will be more fully explained below, the propeller shaft 42 includes an inner surface defining the axial bore 218 and including a relatively large diameter forward surface 220, a relatively small diameter rearward surface 222, and a cam surface 224 angling between the forward surface 220 and the rearward surface 222.

Figure 13:
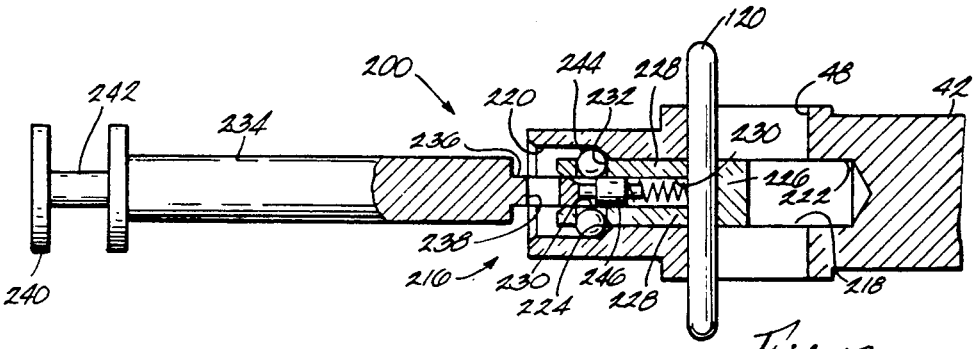

As shown in FIG. 13, the shift shaft 216 includes a rearward portion 226 which is housed entirely within the axial bore 218 of the propeller shaft 42 and which is secured to the clutch dog 82 in the manner previously described. The forward end of the rearward shift shaft portion 226 includes a pair of radially spaced apart wall sections 228 defining therebetween a slot 230 extending in the direction of the fore and aft axis 40. The wall sections 228 are preferably spaced apart a distance approximately equal to the combined thickness of the two wall sections 228 and the radial clearance between the wall sections 228 and the relatively large diameter forward surface 220 is preferably about equal the thickness of one of the wall sections 228. Each of the wall sections 228 is provided with a hole 232 which extends transversely and preferably normally to the slot 230 in the rearward shift shaft portion 226. The holes 232 in the wall sections 228 are coaxially aligned and each has a diameter approximately equal to the distance between the wall sections 228.

The shift shaft 216 also includes a forward portion 234 extending forwardly of the propeller shaft 42 and having a male wall portion 236 which extends rearwardly from the rearward end of the forward shift shaft portion 234 and which is insertable between the wall sections 228 and into the slot 230. The male wall portion 236 has therein a normally extending cavity or hole 238 which is approximately the same size as the holes 232 in the wall sections 228 and which is coaxially alignable therewith when the male wall portion 236 is inserted into the slot 230.

To couple the forward shift shaft portion 234 to the shift lever 204, means are provided on the forward end of the forward shift shaft portion 234 for connecting the forward shift shaft portion 234 to the shift lever 204 to effect movement of the forward shift shaft portion 234 along the fore and aft axis 40 responsive to pivotal movement of the shift lever 204. While various means for connecting the forward shift shaft portion 234 to the shift lever 204 can be used, in the illustrated construction the connecting means includes an enlarged forward end on the forward shift shaft portion 234 which is formed as a generally spool-shaped cradle section 240.

The cradle section 240 includes an annular groove 242 in which the outer end 210 of the second leg 208 is received. The cradle section 240 permits rotation of the forward shift shaft portion 234 without interfering with the connection between the shift lever 204 and the forward shift shaft portion 234. Since the cradle section 240 need not be inserted through the bore 70 in the shift housing 68, as was the case in the previously disclosed construction, the bore 70 need only be sized to support and to accommodate passage therethrough of the rearward end of the forward shift shaft portion 234.

The shift shaft 216 also includes means for connecting the rearward and forward shift shaft portions 226 and 23 to effect common movement thereof along the fore and aft axis 40 in response to pivotal movement of the shift lever 94. In the illustrated arrangement, such connecting means also connects the rearward and forward shift shaft portions 226 and 234 for common rotary movement. While various means for connecting the rearward and forward shift shaft portions 226 and 234 for common axial and rotary movement can be employed, in the illustrated arrangement such connecting means also functions to releaseably and operatively engage or assemble the rearward and forward shift shaft portions 226 and 234 incident to forward displacement of the rearward shift shaft portion 226. As shown in FIGS. 10–18, such connecting means includes a pair of coupling members such as pins or balls 244 which preferably are slightly smaller than the holes 232 in the wall sections 228 and the hole 238 in the male wall portion 236. Each of the balls 244 is partially housed in one of the holes 232 in the wall sections 228.

Figure 12:
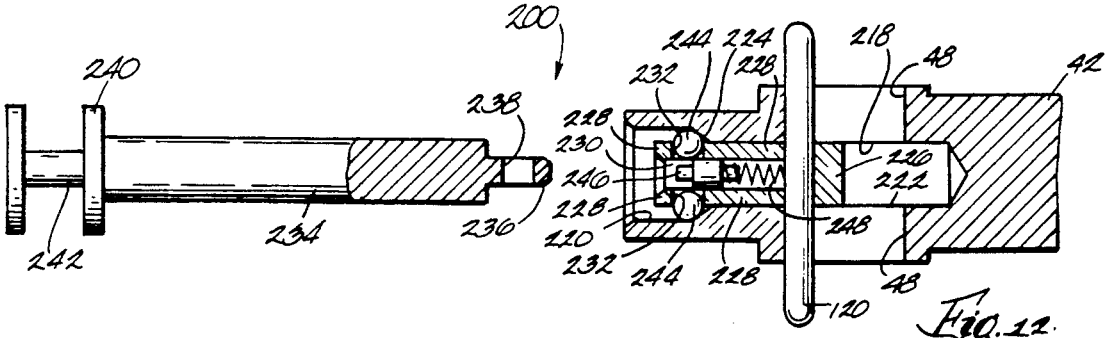
FIGS. 12–18 are partially schematic side views, each partially in section, illustrating assembly and operation of certain components of the transmission shifting arrangement included in the transmission shown in FIG. 10. More particularly.
Figure 14:
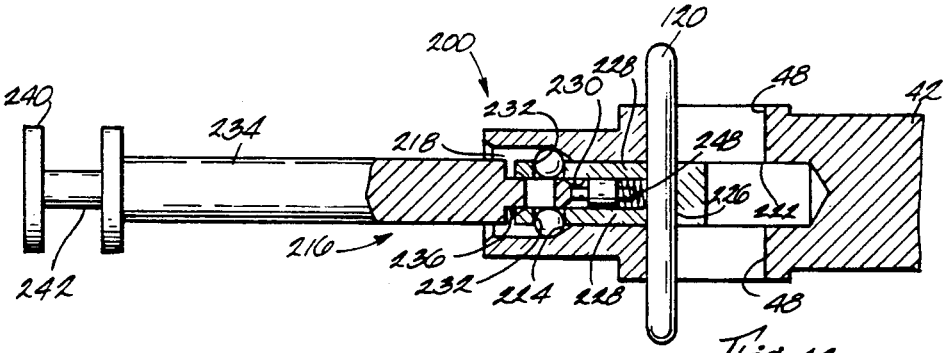

The connecting means also includes means for biasing the balls 244 radially outwardly so as to hold the balls 244 in a preassembled position (shown in FIGS. 12–14). While various biasing means can be employed, in the illustrated arrangement the biasing means includes a block member 246 positioned within the slot 230 in the rearward shift shaft portion 226. A compression spring 248 is provided in the slot 230 rearwardly of the block member 246 for biasing the block member 246 forwardly toward a position which preferably intersects the common axis of the holes 232 in the wall sections 228 to restrict movement of the balls 244 into the slot 230 when the rearward and forward shift shaft portions 226 and 234 are in disassembled relation (see FIGS. 12–13). While the block connecting member restricts movement of the balls 244 into the slot 230, the relatively large forward surface 220 of the propeller shaft 42 restricts radially outward movement of the balls 244 so as to confine the balls 244 partially within the holes 232 in the wall sections 228. Thus, the forward surface 220 and the block member 246 cooperate to maintain the balls 244 in the preassembled position and to prevent accidental removal of the balls 244 from the axial bore 218 of the propeller shaft 42. Similarly if the forward portion of the shift shaft 234 were to hold the balls, the rearward portion of the bore 70 of the shifter housing 68 or some other bore having a rearwardly opening face would have a enlarged diameter and a camming surface to a smaller forward diameter.

Figure 15:
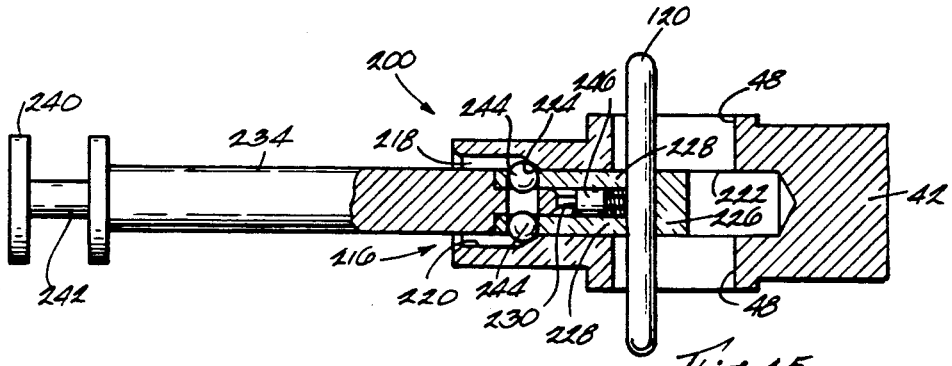
Figure 16:
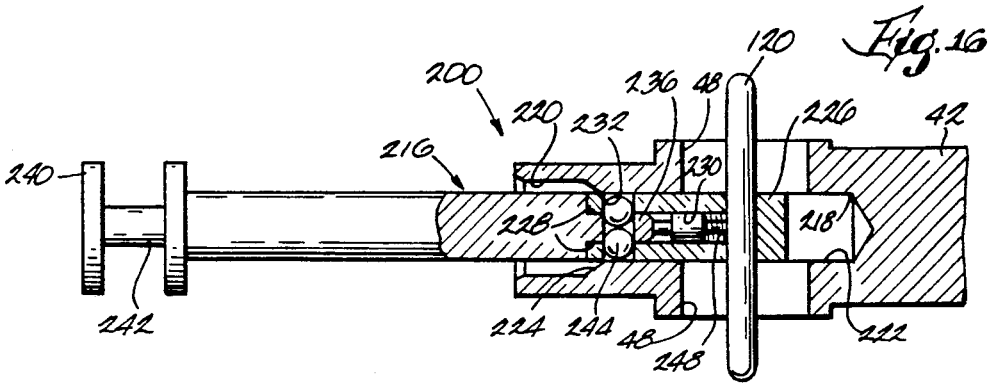
Figure 17:
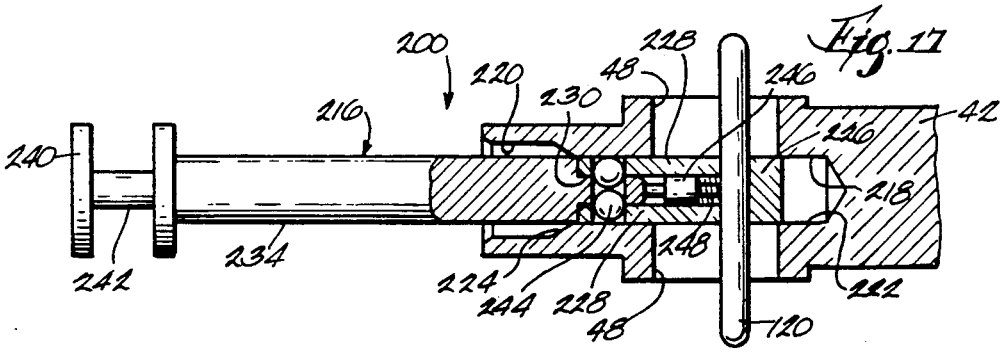
Figure 18:
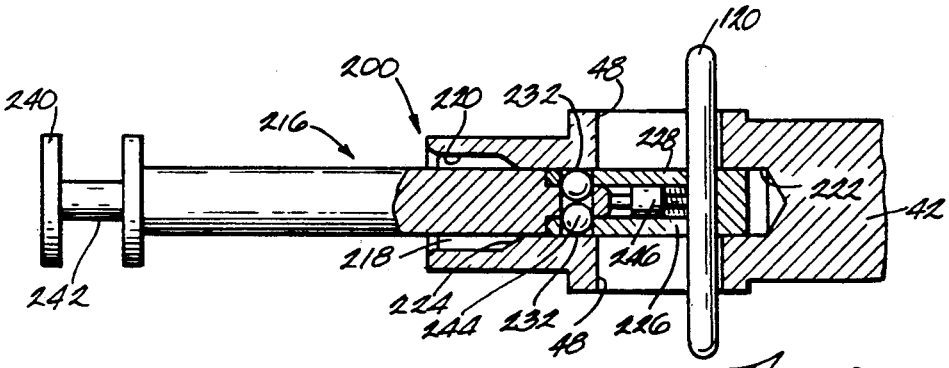

To assemble the shift shaft 216, the propeller shaft 42 containing the rearward shift shaft portion 226 is moved forwardly relative to the forward shift shaft portion 234 such that the male wall portion 236 enters the slot 230 in the rearward shift shaft portion 226 and engages the block member 246 (FIG. 13). Further forward advance of the propeller shaft 42 forces the balls 244 into contact with the cam surface 224 and causes compression of the spring 248 and rearward displacement of the block member 246, however the balls 244 are still prevented from radially inward movement by either the block member 246 or the male wall portion 236 (FIG. 14). Still further forward advance of the propeller shaft 42 causes the hole 238 in the male wall portion 236 to align with the holes 232 in the rearward shift shaft portion 226 (FIG. 15). Thereafter, movement of the shift shaft 216 relative to the propeller shaft 42 urges the balls 244 into the aligned holes 232 and 238 via the camming action of the cam surface 232. Such camming continues until the shift shaft 116 reaches a position within its normal operating range wherein the balls 244 are confined by the relatively small diameter rearward surface 222 and wherein the shift shaft 216 is fully assembled. When the shift shaft 216 is in the normal operating range each of the balls 244 is partially housed in the hole 238 in the male wall portion 236 and in one or the other of the holes 232 in the rearward shift shaft portion 226 to retain the male wall portion 236 in the slot 230. Preferably, one half of each of the balls 244 is housed in the hole 238 while the other half of each of the balls 244 is housed in the respective holes 232. Housing the balls 244 in this position facilitates the transmission of force between the rearward and forward shift shaft portions 226 and 234 such that the rearward and forward shift shaft portions 226 and 234 are coupled for common axial and rotary movement. This arrangement also helps to reduce friction and wear of the components.

The normal operating range of the shift shaft 216 is defined between a first position (FIG. 16) corresponding to the first drive position of the clutch dog 82, and a second position (FIG. 18) corresponding to the second drive position of the clutch dog 82. A neutral position (FIG. 17) is also included within the normal operating range. Once in the normal operating range, the shift shaft 216 is selectively shiftable between the forward drive position, the neutral position and the reverse drive position in response to pivotal movement of the shift lever 204.

To disassemble the shift shaft 216, the previously described assembling operation is reversed such that the balls 244 are again positioned forwardly of the cam surface 224 and wherein the block member 246 is returned to its functional position under the influence of the spring 248. However, when the transmission 58 is fully assembled the shift shaft 216 is limited to movement within the shift range, and disassembly of the shift shaft 216 is prevented.

Assembly of a transmission employing the shift shaft assembly 200 is similar to that previously disclosed, except that the forward shift shaft portion 234 is preferably preassembled with the shift lever 208 and on the shift housing 68 as part of the shift housing assembly. Also, the rearward shift shaft portion 226, together with the block member 246, and the balls 244 are preassembled in the axial bore 218 in the propeller shaft 242 as part of the propeller shaft assembly.

More specifically, assembly in the gearcase 34 of the transmission 58 employing the shift assembly 200 includes inserting the shift rod coupler 212 into the guideway 72 of the shift housing 68, preassembling the shift lever 204 in the shift housing 68 for pivotal movement relative thereto, preassembling the forward shift shaft portion 234 on the shift housing 68 such that the cradle section 240 receives the outer end 210 of the second shift lever leg 208 and such that the rearward part of the forward shift shaft portion 234 extends through the bore 70, and also preferably assembling the forwardly located bevel gear 64 in the shift housing 68 to thereby form a shift housing assembly including the aforementioned components. The shift housing assembly is then inserted into the gearcase cavity 34 and the shift rod 92 and the pinion 60 can thereafter be respectively secured to the shift rod coupler 212 and fixed to the drive shaft 56 in meshing engagement with the forwardly located bevel gear 64. A propeller shaft assembly formed by preassembling the rearward shift shaft portion 26, the balls 244, the block member 246 and the spring 248 in the axial bore 218 of the propeller shaft 42, preassembling the thrust canister 78 and the rearwardly located bevel gear 66 on the propeller shaft 42 forwardly of the thrust ring 50, preassembling the bearing retainer 80 on the propeller shaft 42, and connecting the clutch dog 82 to the rearward shift shaft portion 226, is then inserted forwardly into the gearcase cavity 34 so as to mount the rearwardly located bevel gear 66 in meshing engagement with the pinion 60 and to automatically assemble the rearward and forward shift shaft portions 226 and 234 as previously described. Thereafter the propeller shaft bearing retainer 82 is fixed in place to releaseably prevent propeller shaft removal.

Advantageously, the disclosed constructions enable fixing or "torquing" of the drive pinion 60 on the drive shaft 56 without interference from the propeller shaft 42 and/or the dog clutch 82 in both standard and counter rotation transmissions and without special tooling in a relatively easy manner. In addition, the disclosed constructions enable use of a one-piece propeller shaft in both standard rotation and counter rotation transmission arrangements, thereby affording more ready assembly of the transmission 58 in the gearcase 32 and providing significant cost savings.

Various of the features of the invention are set forth in the following claims.

I claim:

1. A marine propulsion device comprising a lower unit including a gearcase, a propeller shaft mounted in said gearcase for rotation about a generally horizontal fore and aft axis and having an axially extending forwardly opening bore, a shift shaft including a rearward portion located in said bore, a forward portion, and means for connecting said forward portion to said rearward portion to effect common axial movement of said forward and rearward portions in both directions along said fore and aft axis, a shift lever supported by said lower unit for rotary movement about a horizontal axis transverse to said fore and aft axis, being adapted to be connected to a vertically shiftable link to thereby rock said lever about said transverse horizontal axis, and including a leg, and means for connecting said leg to said forward portion of said shift shaft to effect movement of said forward portion of said shift shaft in both directions along said fore and aft axis in response to rotary shift lever movement, one of said means for connecting said forward portion to said rearward portion and said means for connecting said leg to said forward portion including assembling means operable incident to forward displacement of said rearward portion of said shift shaft to effect such connection thereof so as thereafter to effect displacement of said shift shaft in both directions along said fore and aft axis in response to rocking movement of said shift lever about said transverse horizontal axis.

2. A marine propulsion device in accordance with claim 1 wherein said assembling means is operable incident to forward displacement of said rearward portion of said shift shaft to effect the connection of said leg to said forward portion of said shift shaft, wherein said forward portion of said shift shaft has a forward end, and wherein said assembling means includes an upwardly open recess on said forward end of said forward portion of said shift shaft, and a transversely extending pin on said leg and receivable in said recess.

3. A marine propulsion device in accordance with claim 1 wherein said means for connecting said forward portion of said shift shaft to said rearward portion of said shift shaft connects said forward and rearward portions of said shift shaft for common rotary movement about said fore and aft axis, wherein said assembling means is operable incident to forward displacement of said rearward portion of said shift shaft to effect the connection of said forward and rearward portions of said shift shaft, wherein said forward portion of said shift shaft includes a rearward end and said rearward portion of said shift shaft includes a forward end, and wherein said assembling means includes a slot in one of said forward end of said rearward portion and said rearward end of said forward portion, and a male member on the other of said forward end of said rearward portion and said rearward end of said forward portion, said male member being inserted in said slot incident to forward displacement of said rearward portion relative to said forward portion.

4. A marine propulsion device in accordance with claim 3 wherein each of said forward portion of said shift shaft and said rearward portion of said shift shaft are coaxial with said fore and aft axis.

5. A marine propulsion device in accordance with claim 3 wherein said forward portion of said shift shaft includes a forward end, and wherein said means for connecting said leg to said forward portion of said shift shaft includes a cradle section on said forward end of said forward portion of said shift shaft and including an annular groove, said leg extending into said annular groove.

6. A marine propulsion device in accordance with claim 3 wherein said rearward portion of said shift shaft is positioned entirely within said forwardly opening axial bore of said propeller shaft.

7. A marine propulsion device comprising a lower unit including a gearcase, a propeller shaft mounted in said gearcase for rotation about a generally horizontal fore and aft axis and having an axially extending forwardly opening bore, a shift shaft including a rearward portion located in said bore and including a forward end, a forward portion including a rearward end, and means for connecting said forward portion to said rearward portion to effect common axial movement of said forward and rearward portions in both directions along said fore and aft axis, a shift lever supported by said lower unit for rotary movement about a horizontal axis transverse to said fore and aft axis, being adapted to be connected to a vertically shiftable link to thereby rock said lever about said transverse horizontal axis, and including a leg, and means for connecting said leg to said forward portion of said shift shaft to effect movement of said forward portion of said shift shaft in both directions along said fore and aft axis in response to rotary shift lever movement, one of said means for connecting said forward portion to said rearward portion and said means for connecting said leg to said forward portion including assembling means operable incident to forward displacement of said rearward portion of said shift shaft to effect such connection thereof so as thereafter to effect displacement of said shift shaft in both directions along said fore and aft axis in response to rocking movement of said shift lever about said transverse horizontal axis, said assembling means being operable incident to forward displacement of said rearward portion of said shift shaft to effect the connection of said forward and rearward portions of said shift shaft, and said assembling means including a slot in one of said forward end of said rearward portion and said rearward end of said forward portion, and a male member on the other of said forward end of said rearward portion and said rearward end of said forward portion, said male member being inserted in said slot incident to forward displacement of said rearward portion relative to said forward portion, said one of said forward end of said rearward portion and said rearward end of said forward portion having therein a hole oriented transversely to said slot, said male portion including a cavity alignable with said hole incident to insertion of said male portion into said slot, and said assembling means including means for retaining said male portion in said slot, said means for retaining including a coupling member partially received in said hole and partially received in said cavity when said hole and said cavity are aligned to connect said forward and rearward portions of said shift shaft for common movement along said fore and aft axis and relative to said propeller shaft.

8. A marine propulsion device in accordance with claim 7 wherein said assembling means includes means, engageable with said male portion, for biasing said coupling member radially outwardly prior to alignment of said hole and said cavity.

9. A marine propulsion device in accordance with claim 8 wherein said means for biasing includes a block member in said slot and a spring between said block member and said one of said forward end of said rearward portion and said rearward end of said forward portion for urging said block member to a position adjacent said hole.

10. A marine propulsion device in accordance with claim 7 wherein said propeller shaft includes an inner surface defining said forwardly opening axial bore and including a cam surface which is engageable with said coupling member to cam said coupling member radially inwardly and partially into said cavity when said hole and said cavity are aligned.

11. A marine propulsion device in accordance with claim 10 wherein said inner surface includes a rearward surface extending rearwardly from said cam surface and defining a reduced diameter portion of said forwardly opening axial bore, and wherein said rearward surface prevents said coupling member from moving radially outwardly to insure common movement of said forward and rearward portions of said shift shaft within a normal operating range.

12. A marine propulsion device in accordance with claim 11 wherein said marine propulsion device further includes a clutch dog supported on said propeller shaft for common rotary movement and for axial movement relative to said propeller shaft, said clutch dog being connected to said rearward portion of said shift shaft for common movement therewith, wherein said shift shaft is movable relative to said propeller shaft in both directions along said fore and aft axis between a pair of drive positions defining said normal operating range.

13. A marine propulsion device comprising a lower unit including a gearcase, a propeller shaft mounted in said gearcase for rotation about a generally horizontal fore and aft axis and having an axially extending forwardly opening bore, a shift shaft including a rearward portion located in said bore and including a forward end, a forward portion including a rearward end, and means for connecting said forward portion to said rearward portion to effect common axial movement of said forward and rearward portions in both directions along said fore and aft axis, a shift lever supported by said lower unit for rotary movement about a horizontal axis transverse to said fore and aft axis, being adapted to be connected to a vertically shiftable link to thereby rock said lever about said transverse horizontal axis, and including a leg, and means for connecting said leg to said forward portion of said shift shaft to effect movement of said forward portion of said shift shaft in both directions along said fore and aft axis in response to rotary shift lever movement, one of said means for connecting said forward portion to said rearward portion and said means for connecting said leg to said forward portion including assembling means operable incident to forward displacement of said rearward portion of said shift shaft to effect such connection thereof so as thereafter to effect displacement of said shift shaft in both directions along said fore and aft axis in response to rocking movement of said shift lever about said transverse horizontal axis, said assembling means being operable incident to forward displacement of said rearward portion of said shift shaft to effect the connection of said forward and rearward portions of said shift shaft, said assembling means including a slot in one of said forward end of said rearward portion and said rearward end of said forward portion, and a male member on the other of said forward end of said rearward portion and said rearward end of said forward portion, said male member being inserted in said slot incident to forward displacement of said rearward portion relative to said forward portion, said forward end of said rearward portion including a pair of radially spaced apart wall sections defining therebetween said slot, each of said wall sections having therein a hole, said male portion extending rearwardly from said rearward end of said forward portion of said shift shaft and including a hole coaxially alignable with said holes in said wall sections incident to forward displacement of said rearward portion relative to said forward portion, and said assembling means including a pair of coupling members respectively partially received in said holes in said wall sections and respectively partially receivable in said hole in said male portion when said holes in said wall sections are aligned with said hole in said male portion to thereby connect said forward and rearward portions of said shift shaft for common movement.

14. A propeller shaft assembly for use with a pivotally mounted shift actuator, said propeller shaft assembly comprising a propeller shaft having a longitudinal axis and a forwardly open axial bore, a clutch dog mounted on said propeller shaft for common rotary movement with said propeller shaft and for axial movement relative to said propeller shaft, and a shift shaft including a rearward portion located within said bore and fixed to said clutch dog for common axial and rotary movement therewith, a forward portion having a forward end, and means for connecting said forward portion to said rearward portion to effect common axial movement of said forward and rearward portions in both directions along said axis, and means for assembling together one of the shift actuator with said forward portion of said shift shaft and said forward portion of said shift shaft with said rearward portion of said shift shaft incident to forward displacement of said rearward portion of said shift shaft so as to thereafter effect displacement of said shift shaft in the direction of said longitudinal axis in response to movement of the shift actuator.

15. A propeller shaft assembly in accordance with claim 14 wherein said assembling means is operable incident to forward displacement of said rearward portion of said shift shaft to effect the connection of the shift actuator to said forward portion of said shift shaft, wherein said forward portion of said shift shaft has a forward end, and wherein said assembling means includes an upwardly open recess on said forward end of said forward portion of said shift shaft, and a transversely extending pin on the shift mechanism and receivable in said recess.

16. A propeller shaft assembly in accordance with claim 14 wherein said means for connecting said forward portion of said shift shaft to said rearward portion of said shift shaft connects said forward and rearward portions of said shift shaft for common rotary movement about said longitudinal axis, wherein said assembling means is operable incident to forward displacement of said rearward portion of said shift shaft to effect the connection of said forward and rearward portions of said shift shaft, wherein said forward portion of said shift shaft includes a rearward end and said rearward portion of said shift shaft includes a forward end, and wherein said assembling means includes a slot in one of said forward end of said rearward portion and said rearward end of said forward portion, and a male member on the other of said forward end of said rearward portion and said rearward end of said forward portion, said male portion being inserted in said slot incident to forward displacement of said rearward portion relative to said forward portion.

17. A propeller shaft assembly in accordance with claim 16 wherein each of said forward portion of said shift shaft and said rearward portion of said shift shaft are coaxial with said axis.

18. A propeller shaft assembly in accordance with claim 16 wherein said forward portion of said shift shaft includes a forward end, and wherein said means for connecting the shift actuator to said forward portion of said shift shaft includes a cradle section on said forward end of said forward portion of said shift shaft and including an annular groove, the shift actuator including a leg extending into said annular groove.

19. A propeller shaft assembly in accordance with claim 16 wherein said rearward portion of said shift shaft is positioned entirely within said forwardly opening axial bore of said propeller shaft.

20. A propeller shaft assembly in accordance with claim 14 wherein said propeller shaft is of one-piece construction.

21. A propeller shaft assembly for use with a shift actuator, said propeller shaft assembly comprising a propeller shaft having a longitudinal axis and a forwardly open axial bore, a clutch dog mounted on said propeller shaft for common rotary movement with said propeller shaft and for axial movement relative to said propeller shaft, and a shift shaft including a rearward portion located within said bore, including a forward end, and fixed to said clutch dog for common axial and rotary movement therewith, a forward portion having a rearward end, and means for connecting said forward portion to said rearward portion to effect common axial movement of said forward and rearward portions in both directions along said axis, and means for assembling together one of the shift actuator with said forward portion of said shift shaft and said forward portion of said shift shaft with said rearward portion of said shift shaft incident to forward displacement of said rearward portion of said shift shaft so as to thereafter effect displacement of said shift shaft in the direction of said longitudinal axis in response to movement of the shift actuator, said assembling means being operable incident to forward displacement of said rearward portion of said shift shaft to effect the connection of said forward and rearward portions of said shift shaft, said assembling means including a slot in one of said forward end of said rearward portion and said rearward end of said forward portion, and a male member on the other of said forward end of said rearward portion and said rearward end of said forward portion, said male member being inserted in said slot incident to forward displacement of said rearward portion relative to said forward portion, said one of said forward end of said rearward portion and said rearward end of said forward portion having therein a hole oriented transversely to said slot, said male member including a cavity alignable with said hole incident to insertion of said male member into said slot, and said assembling means including means for retaining said male member in said slot, said means for retaining including a coupling member partially received in said hole and partially received in said cavity when said hole and said cavity are aligned to connect said forward and rearward portions of said shift shaft for common movement along said longitudinal axis and relative to said propeller shaft.

22. A propeller shaft assembly in accordance with claim 21 wherein said assembling means includes means engageable with said male portion for biasing said coupling member radially outwardly prior to alignment of said hole and said cavity.

23. A propeller shaft assembly in accordance with claim 22 wherein said means for biasing includes a block member in said slot and a spring between said block member and said one of said forward end of said rearward portion and said rearward end of said forward portion for urging said block member to a position adjacent said hole.

24. A propeller shaft assembly in accordance with claim 21 wherein said propeller shaft includes an inner surface defining said forwardly opening axial bore and including a cam surface which is engageable with said coupling member to cam said coupling member radially inwardly and partially into said cavity when said hole and said cavity are aligned.

25. A propeller shaft assembly in accordance with claim 24 wherein said inner surface includes a rearward surface extending rearwardly from said cam surface and defining a reduced diameter portion of said forwardly opening axial bore, and wherein said rearward surface prevents said coupling member from moving radially outwardly to insure common movement of said forward and rearward portions of said shift shaft within a normal operating range.

26. A propeller shaft assembly for use with a shift actuator, said propeller shaft assembly comprising a propeller shaft having a longitudinal axis and a forwardly open axial bore, a clutch dog mounted on said propeller shaft for common rotary movement with said propeller shaft and for axial movement relative to said propeller shaft, and a shift shaft including a rearward portion located within said bore, including a forward end, and fixed to said clutch dog for common axial and rotary movement therewith, a forward portion having a rearward end, and means for connecting said forward portion to said rearward portion to effect common axial movement of said forward and rearward portions in both directions along said axis, and means for assembling together one of the shift actuator with said forward portion of said shift shaft and said forward portion of said shift shaft with said rearward portion of said shift shaft incident to forward displacement of said rearward portion of said shift shaft so as to thereafter effect displacement of said shift shaft in the direction of said longitudinal axis in response to movement of the shift actuator, said assembling means being operable incident to forward displacement of said rearward portion of said shift shaft to effect the connection of said forward and rearward portions of said shift shaft, said assembling means including a slot in one of said forward end of said rearward portion and said rearward end of said forward portion, a male member on the other of said forward end of said rearward portion and said rearward end of said forward portion, said male member being inserted in said slot incident to forward displacement of said rearward portion relative to said forward portion, said forward end of said rearward portion including a pair of radially spaced apart wall sections defining therebetween said slot, each of said wall sections having therein a hole, said male member extending rearwardly from said rearward end of said forward portion of said shift shaft and including a hole coaxially alignable with said holes in said wall sections incident to forward displacement of said rearward portion relative to said forward portion, and a pair of coupling members respectively partially received in said holes in said wall sections and respectively partially receivable in said hole in said male portion when said holes in said wall sections are aligned with said hole in said male portion to thereby connect said forward and rearward portions of said shift shaft for common movement.

27. A marine propulsion device comprising a lower unit including a gearcase, a propeller shaft mounted in said gearcase for rotation about a generally horizontal fore and aft axis and having an axially extending forwardly opening bore, a shift mechanism movably supported in said gearcase, and a shift shaft having a rearward portion located in said bore and a forward portion assembled to said shift mechanism to effect movement of said forward portion of said shift shaft in both directions along said fore and aft axis in response to movement of said shift mechanism, and means for connecting said forward portion with said rearward portion incident to forward displacement of said rearward portion to effect such connection so as thereafter to effect common axially and rotary movement of said forward and rearward portions in response to movement of said shift actuator.

28. A propeller shaft assembly for use with a shift actuator, said propeller shaft assembly comprising a propeller shaft having a longitudinal axis and an axial bore, a clutch dog supported on said propeller shaft for axial movement relative to said propeller shaft and for common rotary movement with said propeller shaft, a shift shaft having a first portion located in said bore and a second portion assembled to the shift actuator to effect movement of said second portion of said shift shaft in both directions along said axis in response to movement of the shift actuator, and means for connecting said second portion with said first portion incident to relative axial displacement of said first portion toward said second portion to effect such connection so as thereafter to effect common axially and rotary movement of said first and second portions in response to movement of the shift actuator.

29. A shift shaft for use with a shift actuator to shift a clutch dog relative to a housing having a fore and aft axis and an axial bore, said shift shaft comprising a first portion adapted to be received in the bore, a second portion including a a first end adapted to operably engage the shift actuator, and a second end, and means for assembling together said first and second portions of said shift shaft incident to relative axial displacement of said first portion of said shift shaft toward said second portion of said shift shaft so as thereafter to prevent relative rotation therebetween and to effect displacement of said shift shaft in the direction of said fore and aft axis in response to actuating movement of the shift mechanism.

30. A marine propulsion device comprising a lower unit including a gearcase, a propeller shaft mounted in said gearcase for rotation about a generally horizontal fore and aft axis and having an axially extending forwardly opening bore, a shift shaft located in said bore and including a forward portion, a shift lever supported by said lower unit for rotary movement about a horizontal axis transverse to said fore and aft axis, being adapted to be connected to a vertically shiftable link to thereby rock said lever about said transverse horizontal axis, and including an outwardly extending leg, and means on said leg of said shift lever and on said forward portion of said shift shaft for operably engaging said shift lever with said forward portion of said shift shaft in response to forward movement of said shift shaft, and for displacing said shift shaft in the direction of said fore and aft axis in response to rocking movement of said shift lever about said transverse horizontal axis when said shift lever and said shift shaft are operably engaged.

31. A marine propulsion device in accordance with claim 30 wherein said forward portion of said shift shaft has a forward end, and wherein said means on said leg of said shift lever and on said shift shaft comprises an upwardly open recess on said forward end of said forward portion of said shift shaft and a transversely extending pin carried by said outwardly extending leg of said shift lever and received in said recess.

32. A marine propulsion device in accordance with claim 31 wherein shift lever is movable within a shift range between spaced drive positions, and wherein said recess includes a rearward generally vertically extending wall adjacent said pin when said shift shaft is in one of said drive positions and a forward generally vertically extending wall adjacent said pin when said shift shaft is in the other of said drive positions.

33. A marine propulsion device in accordance with claim 31 wherein said recess has a lower semi-cylindrical portion extending upwardly from a location at least partially below said propeller shaft axis.

34. A marine propulsion device in accordance with claim 31 wherein said pin has a uniform cross section taken perpendicularly to said propeller shaft axis.

35. A marine propulsion device in accordance with claim 31 wherein said recess extends upwardly from below said propeller shaft axis and wherein said propeller shaft axis extends through said recess.

36. A marine propulsion device in accordance with claim 31 wherein said pin extends outwardly from both sides of said propeller shaft axis.

37. A marine propulsion device in accordance with claim 30 wherein said forward portion of said shift shaft is non-rotatable, and said shift shaft also includes a rearward portion adapted to be fixedly connected to a clutch dog carried by said propeller shaft for common rotation, and means connecting said rearward and forward portions of said shift shaft for common axial movement and for relative rotary movement.

38. A marine propulsion device in accordance with claim 37 wherein said means connecting said rearward and forward portions of said shift shaft includes formation of the forward part of said rearward portion with a reduced diameter end section and with an annular groove rearwardly of said end section, and formation of the rearward part of said forward portion with a slot receiving said end section of said rearward portion and with a projection extending into said annular groove.

39. A marine propulsion device in accordance with claim 37 wherein said means connecting said rearward and forward portions of said shift shaft includes an annular groove in the forward part of the rearward portion, a bore in the rearward part of the forward portion for receiving the forward part of said rearward portion, a semi-annular slot in the forward portion in alignment with said annular groove and a clip extending in said slot and said groove.

40. A marine propulsion device in accordance with claim 37 wherein said means connecting said rearward and forward portions of said shift shaft is located within said propeller shaft bore.

41. A marine propulsion device comprising a lower unit including a gearcase, a propeller shaft mounted in said gearcase for rotation about a generally horizontal fore and aft axis and having an axially extending forwardly opening bore, a shift shaft located in said bore and including a forward portion including a forward end, a shift lever supported by said lower unit for rotary movement about a horizontal axis transverse to said fore and aft axis, movable within a shift range between spaced drive positions, and to an assemble position outside of the shift range and spaced from one of said drive positions, being adapted to be connected to a vertically shiftable link to thereby rock said lever about said transverse horizontal axis, and including an outwardly extending leg, and means on said leg of said shift lever and on said forward portion of said shift shaft for operably engaging said shift lever with said forward portion of said shift shaft in response to forward movement of said shift shaft, and for displacing said shift shaft in the direction of said fore and aft axis in response to rocking movement of said shift lever about said transverse horizontal axis when said shift lever and said shift shaft are operably engaged, said means on said leg of said shift lever and on said shift shaft comprising a transversely extending pin carried by said outwardly extending leg of said shift lever, an upwardly open recess which is located on said forward end of said forward portion of said shift shaft, which receives said pin, and which includes a rearward generally vertically extending wall adjacent said pin when said shift shaft is in one of said drive positions and a forward generally vertically extending wall adjacent said pin when said shift shaft is in the other of said drive positions, and an end wall extending upwardly from said rearward vertically extending wall and located for engagement with said pin when said shift lever is in the assemble position and in response to forward movement of said shift shaft.

42. A marine propulsion device in accordance with claim 41 wherein said shift lever is pivotally mounted about an axis located above said end wall.

43. A marine propulsion device in accordance with claim 41 wherein said forward wall has a top surface located below said pin when said pin is in the assemble position, and wherein said end wall extends above said top surface of said forward wall to permit, when said pin is in the assemble position and in response to forward movement of said shift shaft, passage of said pin above said top surface of said forward wall and into engagement with said end wall so as thereafter to effect movement of said pin into said recess and into the shift range in response to continued forward movement of said shift shaft.

44. A marine propulsion device in accordance with claim 43 wherein, when said pin is located in said shift range, said pin is located below the top surface of said forward wall so as to prevent withdrawal of said pin from said recess.

45. A marine propulsion device in accordance with claim 44 wherein said pin has a thickness in the fore and aft direction and wherein said forward and rearward walls are spaced in the fore and aft direction at a distance slightly greater than the fore and aft thickness of said pin so as to effect movement of said shift shaft in the fore and aft direction in response to rocking movement of said shift lever within the shift range.

46. A marine propulsion device comprising a lower unit including a gearcase having therein a cavity, a propeller shaft mounted in said gearcase cavity for rotation about a horizontal fore and aft axis and having an axially extended forwardly opening bore, a shift shaft located in said bore and including a rearward portion, a forward portion, and means connecting said forward and rearward portions for common axial movement and for relative rotary movement, a bell crank shift lever supported by said lower unit for rotary movement about a horizontal axis transverse to said fore and aft axis and within and relative to a shift range and to an assemble position spaced from said shift range and including a first leg adapted to be connected to a vertically shiftable link to thereby rock said shift lever about said transverse horizontal axis and a second leg extending in angular relation to said first leg and into said gearcase cavity, and means on said second leg of said shift lever and on said forward portion of said shift shaft for operably engaging said shift lever with said shift shaft when said shift lever is in said assemble position and in response to forward movement of said shift shaft, for preventing rotation of said shift shaft forward portion about said fore and aft axis when said shift lever and said shift shaft are operably engaged and said shift lever is in said shift range, for preventing disassembly of said shift lever and said shift shaft when said shift lever and said shift shaft are operably engaged and said shift lever is in said shift range, and for displacing said shift shaft in the direction of said fore and aft axis in response to rocking movement of said shift lever about said transverse horizontal axis and within said shift range when said shift lever and said shift shaft are operably engaged.

47. A propeller shaft assembly comprising a propeller shaft having a longitudinal axis and a forwardly open axial bore, a bevel gear in surrounding relation to said propeller shaft, a dog clutch mounted on said propeller shaft adjacent said bevel gear for common rotary movement with said propeller shaft and for axial movement relative to said propeller shaft, and a shift shaft located in said axial bore for axial movement relative to said propeller shaft and including a rearward portion fixed to said clutch dog for common axial and rotary movement, a forward portion having a forward end with a recess which extends transversely of said longitudinal axis and which has an upwardly directed opening enabling receipt through said opening of a cross pin on a shift lever to effect movement of said forward portion of said shift shaft in response to rocking movement of said shift lever, and means connecting said forward and rearward portions of said shift shaft for relative rotary movement therebetween and for common axial movement.

48. A propeller shaft assembly in accordance with claim 47 and further including a thrust canister in surrounding relation to said propeller shaft rearwardly of said bevel gear, and wherein said propeller shaft includes a thrust ring located rearwardly of said thrust canister.

49. A propeller shaft assembly in accordance with claim 47 wherein said propeller shaft is of one-piece construction.

50. A propeller shaft assembly in accordance with claim 47 wherein said recess has a lower semi-cylindrical portion extending upwardly from a location at least partially below said propeller shaft axis.

51. A propeller shaft assembly in accordance with claim 47 wherein said recess extends upwardly from below said propeller shaft axis and wherein said propeller shaft axis extends through said recess.

52. A propeller shaft assembly in accordance with claim 47 wherein said forward portion of said shift shaft includes a cross section taken transversely of said propeller shaft axis and through said recess and which is non-symmetrical about said propeller shaft axis.

53. A propeller shaft assembly in accordance with claim 47 wherein said recess includes a rearward vertically extending wall, and a forward vertically extending wall having a top surface, and wherein said forward portion of said shift shaft also includes an end wall coplanar with said rearward vertically extending wall and extending above said top surface of said forward wall.

54. A propeller shaft assembly in accordance with claim 47 wherein said means connecting said rearward and forward portions of said shift shaft includes formation of the forward part of said rearward portion with a reduced diameter end section and with an annular groove rearwardly of said end section, and formation of the rearward part of said forward portion with a slot receiving said end section of said rearward portion and with a projection extending into said annular groove.

55. A propeller shaft assembly in accordance with claim 47 wherein said means connecting said rearward and forward portions of said shift shaft is located within said propeller shaft bore.

56. A shift shaft having an axis and including a rearward portion adapted to be fixedly connected to a clutch dog for movement in common with the clutch dog, a forward portion having a forward end with a recess which extends transversely to said axis and which has an upwardly directed opening enabling receipt through said opening of a cross pin of a pivotally mounted shift lever so as to effect axial movement of said shift shaft forward portion in response to pivotal movement of the shift lever, and means connecting said rearward and forward portions of said shift shaft for common axial movement and for relative rotary movement.

57. A shift shaft in accordance with claim 56 wherein said recess has a lower semi-cylindrical portion extending upwardly from a location at least partially below the axis of said shift shaft.

58. A shift shaft in accordance with claim 56 wherein said recess extends upwardly from below the axis of said shift shaft and wherein said shift shaft axis extends through said recess.

59. A shift shaft in accordance with claim 56 wherein said forward portion includes a cross section taken transversely of the axis of said shift shaft and through said recess and which is non-symmetrical about said shift shaft axis.

60. A shift shaft in accordance with claim 56 wherein said recess includes a rearward vertically extending wall, and a forward vertically extending wall having a top surface, wherein said forward portion of said shift shaft also includes an end wall coplanar with said rearward vertically extending wall and extending above said top surface of said forward wall.

61. A shift shaft in accordance with claim 56 wherein said means connecting said rearward and forward portions of said shift shaft includes formation of the forward part of said rearward portion with a reduced diameter end section and with an annular groove rearwardly of said end section, and formation of the rearward part of said forward portion with a slot receiving said end section of said rearward portion and with a projection extending into said annular groove.

62. A marine propulsion device comprising a lower unit including a gearcase, a propeller shaft mounted in said gearcase for rotation about a horizontal fore and aft axis and having an axially extending forwardly opening bore, a shift shaft located in said bore, including a forward portion, being movable in common with said propeller shaft in the direction of said for and aft axis during assembly of said propeller shaft in said gear case, and being movable relative to said propeller shaft to effect operation of a transmission located in said, gear case, a shift actuator supported by said lower unit for movement, including a portion locateable in the path of forward movement of said shift shaft in the direction of said fore and aft axis, and being adapted to be connected to a shiftable link to thereby move said shift actuator, and means on said portion of said shift actuator and on said forward portion of said shift shaft for operably engaging said shift actuator with said shift shaft in response to forward movement of said shift shaft in the direction of said fore and aft axis, and for displacing said shift shaft in the direction of said fore and aft axis in response to movement of said shift actuator when said shift actuator and said shift shaft are operably engaged.

63. A method of assembling a reversing transmission in a cavity provided in a gearcase of a marine propulsion lower unit, which reversing transmission includes a drive pinion fixed to a drive shaft supported by the lower unit and extending into the gearcase cavity, a shift actuator mounted on the lower unit for pivotal movement, extending in the gearcase cavity, and adapted to be connected to a shift rod mounted in the lower unit for displacement by an operator, a forwardly located bevel gear rotatably mounted in the lower unit and in meshing relation with the drive pinion, a propeller shaft rotatably mounted in the gearcase cavity and extending in co-axial relation to and through the bevel gear and having a forwardly open axial bore, a clutch dog mounted on the propeller shaft for common rotary movement therewith and for selective axial movement relative to the propeller shaft and relative to a position of engagement with the bevel gear, and a shift shaft located in, and axially movable in, the axial bore in the propeller shaft, fixed to the clutch dog for common rotary and axial movement with the clutch dog, and operably engaged with the shift actuator to effect axial movement of the shift shaft in response to movement of the shift actuator, said method comprising the steps of mounting the shift actuator in the lower unit for pivotal movement relative thereto about a fixed axis, rotatably mounting the bevel gear in the lower unit for rotation relative thereto, thereafter fixedly mounting the drive pinion on the drive shaft and in meshing engagement with the bevel gear, preassembling the shift shaft in the axial bore in the propeller shaft, preassembling the clutch dog on the propeller shaft and connecting the clutch dog to the shift shaft for common axial and rotary movement, whereby to provide a propeller shaft assembly including the propeller shaft, the clutch dog, and the shift shaft, and thereafter inserting the propeller shaft assembly into the gearcase cavity so as to operably engage the shift shaft with the shift actuator to afford axial shift shaft movement in response to movement of the shift actuator.

64. A method of assembling a reversing transmission in a cavity provided in a gearcase of a marine propulsion lower unit, which reversing transmission includes a drive pinion fixed to a drive shaft supported by the lower unit and extending into the gearcase cavity, a shift housing non-rotatably received in the gearcase cavity, a shift lever mounted on the shift housing for rotary movement about a horizontal axis, extending in the gearcase cavity, and adapted to be connected to a shift rod mounted in the lower unit for vertical displacement by an operator, a forwardly located bevel gear rotatably mounted in the shift housing and in meshing relation with the drive pinion, a rearwardly located bevel gear rotatably mounted in the gearcase cavity and in meshing relation with the drive pinion, a propeller shaft rotatably mounted in the gearcase cavity and extending in co-axial relation to and through the bevel gears and having a forwardly open axial bore, a clutch dog mounted on the propeller shaft for common rotary movement therewith and for selective relative axial movement therebetween and between spaced positions of engagement with the bevel gears, and a shift shaft located in, and axially movable in, the axial bore in the propeller shaft, fixed to the clutch dog for common rotary and axial movement with the clutch dog, and operably engaged with the shift lever to effect axial movement of the shift shaft in response to rocking movement of the shift lever, said method comprising the steps of preassembling the shift lever in the shift housing for rotary movement relative thereto, preassembling the forwardly located bevel gear in the shift housing for rotation relative thereto, whereby to provide a shift housing assembly including the shift housing, the shift lever, and the forwardly located bevel gear, inserting the shift housing assembly in the gearcase cavity, thereafter fixedly mounting the drive pinion on the drive shaft and in meshing engagement with the forwardly located bevel gear, preassembling the shift shaft in the axial bore in the propeller shaft, preassembling the rearwardly located bevel gear in surrounding relation to the propeller shaft, preassembling the clutch dog on the propeller shaft forwardly of the rearwardly located bevel gear, and connecting the clutch dog to the shift shaft for common axial and rotary movement, whereby to provide a propeller shaft assembly including the propeller shaft, the rearwardly located bevel gear, the clutch dog, and the shift shaft, and thereafter inserting the propeller shaft assembly into the gearcase cavity so as to operably engage the shift shaft with the shift lever to afford axial shift shaft movement in response to pivotal movement of the shift lever, and to rotatably mount the rearwardly located bevel gear in the gearcase cavity and in meshing engagement with the drive pinion.

65. A method of assembling a reversing transmission in a cavity provided in a gearcase of a marine propulsion lower unit, which reversing transmission includes a drive pinion fixed to a drive shaft supported by the lower unit and extending into the gearcase cavity, a shift housing non-rotatably received in the gearcase cavity, a shift lever mounted on the shift housing for rotary movement about a horizontal axis, extending in the gearcase cavity, and adapted to be connected to a shift rod mounted in the lower unit for vertical displacement by an operator, a forwardly located bevel gear rotatably mounted in the shift housing and in meshing relation with the drive pinion, a rearwardly located bevel gear rotatably mounted in the gearcase cavity and in meshing relation with the drive pinion, a thrust canister assembled with the rearwardly located bevel gear and located in operable engagement with the gearcase for transmission of thrust thereto, a propeller shaft bearing retainer in surrounding and engaged relation to the thrust canister, a propeller shaft rotatably mounted in the gearcase cavity and extending in co-axial relation to and through the bevel gears, the thrust canister, and the propeller shaft retainer, and having a forwardly open axial bore and a rearwardly located thrust ring for transmitting forward thrust to the thrust canister, a clutch dog mounted on the propeller shaft for common rotary movement therewith and for selective relative axial movement therebetween and between spaced positions of engagement with the bevel gears, and a shift shaft located in, and axially movable in, the axial bore in the propeller shaft, fixed to the clutch dog for common rotary and axial movement with the clutch dog, and operably engaged with the shift lever to effect axial movement of the shift shaft in response to rocking movement of the shift lever, said method comprising the steps of preassembling the shift lever in the shift housing for rotary movement relative thereto, preassembling the forwardly located bevel gear in the shift housing for rotation relative thereto, whereby to provide a shift housing assembly including the shift housing, the shift lever, and the forwardly located bevel gear, inserting the shift housing assembly in the gearcase cavity, thereafter fixedly mounting the drive pinion on the drive shaft and in meshing engagement with the forwardly located bevel gear, preassembling the thrust canister and the rearwardly located bevel gear to provide a rearward bevel gear assembly, preassembling the bevel gear assembly in surrounding relation to the propeller shaft and forwardly of the thrust ring, preassembling the propeller shaft bearing retainer in surrounding relation to the propeller shaft and in surrounding and engaged relation to the thrust canister, preassembling the shift shaft in the axial bore in the propeller shaft, preassembling the clutch dog on the propeller shaft forwardly of the bevel gear assembly, and connecting the clutch dog to the shift shaft for common axial and rotary movement, whereby to provide a propeller shaft assembly including the propeller shaft, the rearwardly located bevel gear, the thrust canister, the propeller shaft bearing retainer, the clutch dog, and the shift shaft, and thereafter inserting the propeller shaft assembly into the gearcase cavity so as to operably engage the shift shaft with the shift lever to afford axial shift shaft movement in response to pivotal movement of the shift lever, to rotatably mount the rearwardly located bevel gear in the gearcase cavity and in meshing engagement with the drive pinion, and to engage the propeller shaft bearing retainer with the gearcase.

66. A method of assembling a reversing transmission in a gearcase cavity in a marine propulsion lower unit, the reversing transmission including a drive pinion fixed to a drive shaft supported by the lower unit, a shift actuator mounted on the lower unit for movement, and extending into the gearcase cavity, a forwardly located bevel gear rotatably mounted in the lower unit and in meshing engagement with the pinion, a propeller shaft rotatably supported in the gearcase and extending in coaxial relation to and through the bevel gear and having a forwardly opening axial bore, a clutch dog supported on the propeller shaft for common rotary movement therewith and selective axial movement relative thereto and relative to a position of engagement with the bevel gear, and a shift shaft including a rearward portion in the axial bore in the propeller shaft and fixed to the clutch dog for common axial and rotary movement therewith, a forward portion assembled with the shift actuator to effect axial movement of the forward portion in response to movement of the shift actuator, and a coupling member supported on one of the rearward and forward portions and engageable with the other of the rearward an forward portions to assemble the rearward and forward portions for common movement, said method comprising the steps of preassembling the forward portion of the shift shaft and the shift actuator, inserting the preassembled forward portion of the shift shaft and the shift actuator into the gearcase cavity such that the shift actuator is supported for movement relative to the lower unit, rotatably mounting the bevel gear in lower unit, mounting the pinion on the drive shaft and in meshing engagement with the bevel gear, preassembling the rearward portion of the shift shaft in the axial bore of the propeller shaft, preassembling the clutch dog on the propeller shaft and connecting the rearward portion to the clutch dog, inserting the propeller shaft together with the clutch dog and the rearward portion of the shift shaft into the gearcase cavity so as to assemble the rearward and forward portions of the shift shaft such that the coupling member connects the rearward and forward portions to afford common axial movement of the rearward and forward portions of the shift shaft incident to movement of the shift actuator.

* * * * *